US008360847B2

(12) United States Patent
Williams et al.

(10) Patent No.: US 8,360,847 B2
(45) Date of Patent: Jan. 29, 2013

(54) MULTIMEDIA EMULATION OF PHYSICAL REEL HARDWARE IN PROCESSOR-BASED GAMING MACHINES

(75) Inventors: David C. Williams, Carson City, NV (US); John Leagh Beadell, Sparks, NV (US); Joseph Randy Hedrick, Carson City, NV (US); Kurt M. Larsen, Reno, NV (US); Nicholas B. Mayne, Reno, NV (US); Kay D. Vetter, Reno, NV (US)

(73) Assignee: IGT, Reno, NV (US)

( * ) Notice: Subject to any disclaimer, the term of this patent is extended or adjusted under 35 U.S.C. 154(b) by 642 days.

(21) Appl. No.: 11/858,845

(22) Filed: Sep. 20, 2007

(65) Prior Publication Data

US 2008/0113749 A1 May 15, 2008

Related U.S. Application Data

(60) Provisional application No. 60/858,741, filed on Nov. 13, 2006.

(51) Int. Cl.
*A63F 9/24* (2006.01)

(52) U.S. Cl. ..... 463/20; 463/16; 463/17

(58) Field of Classification Search ..... 463/16–20
See application file for complete search history.

(56) References Cited

U.S. PATENT DOCUMENTS

| | | | | |
|---|---|---|---|---|
| 3,708,219 | A | 1/1973 | Forlini et al. | |
| 4,333,715 | A | 6/1982 | Brooks | |
| 4,517,558 | A | 5/1985 | Davids | |
| 4,574,391 | A * | 3/1986 | Morishima | 463/35 |
| 4,607,844 | A | 8/1986 | Fullerton | |
| 4,621,814 | A | 11/1986 | Stephen et al. | |
| 4,659,182 | A | 4/1987 | Aizawa | |
| 4,718,672 | A | 1/1988 | Okada | |
| 4,911,449 | A | 3/1990 | Dickinson et al. | |
| 4,912,548 | A | 3/1990 | Shanker et al. | |
| 5,086,354 | A | 2/1992 | Bass et al. | |
| 5,113,272 | A | 5/1992 | Reamey | |
| 5,132,839 | A | 7/1992 | Travis | |

(Continued)

FOREIGN PATENT DOCUMENTS

| | | |
|---|---|---|
| AU | 721968 | 7/2000 |
| AU | 2000 PQ9586 | 8/2000 |

(Continued)

OTHER PUBLICATIONS

"SPD," Malvino Inc., www.malvino.com, Jul. 19, 1999, 10 pages.

(Continued)

*Primary Examiner* — Dmitry Suhol
*Assistant Examiner* — Jay Trent Liddle
(74) *Attorney, Agent, or Firm* — Weaver Austin Villeneuve & Sampson LLP

(57) ABSTRACT

Gaming machines, systems and methods for providing more realistic emulations of rotating reels are disclosed. Gaming machines include an exterior housing, master gaming controller, display device, speakers and virtual reels. A reel spin timer can be adapted to vary the spin times of the simulated rotating reels from one game play to another, and a reel sound generator can be adapted to provide reel sounds to one or more speakers with respect to the simulated rotating reels. Provided reel sounds can also vary from one game play to another, and both reel spin times and reel sounds can be selected randomly from stored values or files. Stored values or files can include samplings from actual physical reels. A remote host can provide downloadable reel spin times and reel sounds to gaming machines within an associated gaming system.

23 Claims, 6 Drawing Sheets

U.S. PATENT DOCUMENTS

| | | | |
|---|---|---|---|
| 5,152,529 | A | 10/1992 | Okada |
| 5,319,491 | A | 6/1994 | Selbrede |
| 5,342,047 | A | 8/1994 | Heidel et al. |
| 5,364,100 | A | 11/1994 | Ludlow et al. |
| 5,375,830 | A | 12/1994 | Takemoto et al. |
| 5,376,587 | A | 12/1994 | Buchmann et al. |
| 5,393,057 | A | 2/1995 | Marnell |
| 5,393,061 | A | 2/1995 | Manship et al. |
| 5,395,111 | A | 3/1995 | Inoue |
| 5,467,893 | A | 11/1995 | Landis, II et al. |
| 5,539,547 | A | 7/1996 | Ishii et al. |
| 5,580,055 | A | 12/1996 | Hagiwara |
| 5,585,821 | A | 12/1996 | Ishikura et al. |
| 5,589,980 | A | 12/1996 | Bass et al. |
| 5,647,798 | A | 7/1997 | Faiciglia |
| 5,725,428 | A | 3/1998 | Achmueller |
| 5,745,197 | A | 4/1998 | Leung et al. |
| 5,752,881 | A | 5/1998 | Inoue |
| 5,762,552 | A | 6/1998 | Vuong et al. |
| 5,764,317 | A | 6/1998 | Sadovnik et al. |
| 5,785,315 | A | 7/1998 | Eiteneer et al. |
| 5,788,573 | A | 8/1998 | Baerlocher et al. |
| 5,833,537 | A | 11/1998 | Barrie |
| 5,851,148 | A | 12/1998 | Brune et al. |
| 5,853,324 | A | 12/1998 | Kami et al. |
| 5,910,046 | A | 6/1999 | Wada et al. |
| 5,923,307 | A | 7/1999 | Hogle, IV |
| 5,951,397 | A | 9/1999 | Dickinson |
| 5,956,180 | A | 9/1999 | Bass et al. |
| 5,967,893 | A | 10/1999 | Lawrence et al. |
| 5,988,638 | A | 11/1999 | Rodesch et al. |
| 5,993,027 | A | 11/1999 | Yamamoto et al. |
| 6,001,016 | A | 12/1999 | Walker et al. |
| 6,015,346 | A | 1/2000 | Bennett |
| 6,027,115 | A | 2/2000 | Griswold et al. |
| 6,050,895 | A | 4/2000 | Luciano et al. |
| 6,054,969 | A | 4/2000 | Haisma |
| 6,057,814 | A | 5/2000 | Kalt |
| 6,059,289 | A | 5/2000 | Vancura |
| 6,059,658 | A | 5/2000 | Mangano et al. |
| 6,068,552 | A | 5/2000 | Walker |
| 6,086,066 | A | 7/2000 | Takeuchi et al. |
| 6,093,102 | A | 7/2000 | Bennett |
| 6,135,884 | A | 10/2000 | Hedrick et al. |
| 6,159,095 | A | 12/2000 | Frohm et al. |
| 6,159,098 | A | 12/2000 | Slomiany et al. |
| 6,168,520 | B1 | 1/2001 | Baerlocher et al. |
| 6,190,255 | B1 | 2/2001 | Thomas et al. |
| 6,213,875 | B1 | 4/2001 | Suzuki |
| 6,227,971 | B1 | 5/2001 | Weiss |
| 6,234,897 | B1 | 5/2001 | Frohm et al. |
| 6,244,596 | B1 | 6/2001 | Kondratjuk |
| 6,251,013 | B1 | 6/2001 | Bennett |
| 6,251,014 | B1 | 6/2001 | Stockdale et al. |
| 6,252,707 | B1 | 6/2001 | Kleinberger et al. |
| 6,254,481 | B1 | 7/2001 | Jaffe |
| 6,261,178 | B1 | 7/2001 | Bennett |
| 6,270,411 | B1 | 8/2001 | Gura et al. |
| 6,297,785 | B1 | 10/2001 | Sommer et al. |
| 6,315,666 | B1 | 11/2001 | Mastera et al. |
| 6,322,445 | B1 | 11/2001 | Miller |
| 6,337,513 | B1 | 1/2002 | Clevenger et al. |
| 6,347,996 | B1 | 2/2002 | Gilmore et al. |
| 6,368,216 | B1 | 4/2002 | Hedrick et al. |
| 6,379,244 | B1 | 4/2002 | Sagawa et al. |
| 6,398,220 | B1 | 6/2002 | Inoue |
| 6,398,644 | B1 | 6/2002 | Perrie et al. |
| 6,404,436 | B1 | 6/2002 | Goden |
| 6,416,827 | B1 | 7/2002 | Chakrapani et al. |
| 6,444,496 | B1 | 9/2002 | Edwards et al. |
| 6,445,185 | B1 | 9/2002 | Damadian et al. |
| 6,491,583 | B1 | 12/2002 | Gauselmann |
| 6,503,147 | B1 | 1/2003 | Stockdale et al. |
| 6,511,375 | B1 | 1/2003 | Kaminkow |
| 6,512,559 | B1 | 1/2003 | Hashimoto et al. |
| 6,514,141 | B1 | 2/2003 | Kaminkow et al. |
| 6,517,433 | B2 | 2/2003 | Loose et al. |
| 6,517,437 | B1 | 2/2003 | Wells et al. |
| 6,520,856 | B1 | 2/2003 | Walker et al. |
| 6,532,146 | B1 | 3/2003 | Duquette |
| 6,547,664 | B2 | 4/2003 | Saunders |
| 6,575,541 | B1 | 6/2003 | Hedrick et al. |
| 6,585,591 | B1 | 7/2003 | Baerlocher et al. |
| 6,612,927 | B1 | 9/2003 | Slomiany |
| D480,961 | S | 10/2003 | Deadman |
| 6,643,124 | B1 | 11/2003 | Wilk |
| 6,644,664 | B2 | 11/2003 | Muir et al. |
| 6,646,695 | B1 | 11/2003 | Gauselmann |
| 6,652,378 | B2 | 11/2003 | Cannon et al. |
| 6,659,864 | B2 | 12/2003 | McGahn et al. |
| 6,661,425 | B1 | 12/2003 | Hiroaki |
| 6,695,696 | B1 | 2/2004 | Kaminkow |
| 6,695,703 | B1 | 2/2004 | McGahn |
| 6,702,675 | B2 | 3/2004 | Poole et al. |
| 6,712,694 | B1 | 3/2004 | Nordman |
| 6,715,756 | B2 | 4/2004 | Inoue |
| 6,717,728 | B2 | 4/2004 | Putilin |
| 6,722,979 | B2 | 4/2004 | Gilmore et al. |
| 6,791,825 | B1 | 9/2004 | Taylor |
| 6,802,777 | B2 | 10/2004 | Seelig et al. |
| 6,817,945 | B2 | 11/2004 | Seelig et al. |
| 6,817,946 | B2 * | 11/2004 | Motegi et al. ..... 463/31 |
| 6,859,219 | B1 | 2/2005 | Sall |
| 6,887,157 | B2 | 5/2005 | LeMay et al. |
| 6,890,259 | B2 | 5/2005 | Breckner et al. |
| 6,890,262 | B2 | 5/2005 | Oishi et al. |
| 6,906,762 | B1 | 6/2005 | Witehira et al. |
| 6,908,381 | B2 | 6/2005 | Ellis |
| 6,923,441 | B2 | 8/2005 | Inoue |
| 6,937,298 | B2 | 8/2005 | Okada |
| 6,981,635 | B1 | 1/2006 | Hughs-Baird et al. |
| 7,040,987 | B2 | 5/2006 | Walker et al. |
| 7,056,215 | B1 | 6/2006 | Olive |
| 7,084,888 | B2 | 8/2006 | Takahama et al. |
| 7,095,180 | B2 | 8/2006 | Emslie et al. |
| 7,095,450 | B1 | 8/2006 | Holmes et al. |
| 7,097,560 | B2 | 8/2006 | Okada |
| 7,108,603 | B2 | 9/2006 | Olive |
| 7,115,033 | B1 | 10/2006 | Timperley |
| 7,128,647 | B2 | 10/2006 | Muir |
| 7,159,865 | B2 | 1/2007 | Okada |
| 7,160,187 | B2 | 1/2007 | Loose et al. |
| 7,166,029 | B2 | 1/2007 | Enzminger |
| 7,204,753 | B2 | 4/2007 | Ozaki et al. |
| 7,207,883 | B2 | 4/2007 | Nozaki et al. |
| 7,220,181 | B2 | 5/2007 | Okada |
| 7,227,510 | B2 | 6/2007 | Mayer, III et al. |
| 7,237,202 | B2 | 6/2007 | Gage |
| 7,252,288 | B2 | 8/2007 | Seelig et al. |
| 7,252,591 | B2 | 8/2007 | Van Asdale |
| 7,255,643 | B2 | 8/2007 | Ozaki et al. |
| 7,274,413 | B1 | 9/2007 | Sullivan et al. |
| 7,285,049 | B1 | 10/2007 | Luciano, Jr. et al. |
| 7,309,284 | B2 | 12/2007 | Griswold et al. |
| 7,322,884 | B2 | 1/2008 | Emori et al. |
| 7,324,094 | B2 * | 1/2008 | Moilanen et al. ..... 345/173 |
| 7,329,181 | B2 | 2/2008 | Hoshino et al. |
| 7,352,424 | B2 | 4/2008 | Searle |
| 7,439,683 | B2 | 10/2008 | Emslie |
| 7,473,173 | B2 | 1/2009 | Peterson et al. |
| 7,505,049 | B2 | 3/2009 | Engel |
| 7,510,475 | B2 * | 3/2009 | Loose et al. ..... 463/31 |
| 7,558,057 | B1 | 7/2009 | Naksen et al. |
| 7,559,837 | B1 | 7/2009 | Yoseloff et al. |
| 7,582,016 | B2 | 9/2009 | Suzuki |
| 7,619,585 | B2 | 11/2009 | Bell et al. |
| 7,624,339 | B1 | 11/2009 | Engel et al. |
| 7,626,594 | B1 | 12/2009 | Witehira et al. |
| 7,654,899 | B2 * | 2/2010 | Durham et al. ..... 463/30 |
| 7,724,208 | B1 | 5/2010 | Engel et al. |
| 7,730,413 | B1 | 6/2010 | Engel |
| 7,742,124 | B2 | 6/2010 | Bell |
| 7,742,239 | B2 | 6/2010 | Bell |
| 7,841,944 | B2 | 11/2010 | Wells |
| 7,951,001 | B2 | 5/2011 | Wells |
| 8,012,010 | B2 | 9/2011 | Wilson et al. |
| 8,092,304 | B2 * | 1/2012 | Hedrick et al. ..... 463/31 |

8,096,878 B2 * 1/2012 Durham et al. ..... 463/31
8,115,700 B2 2/2012 Schlottmann et al.
8,118,670 B2 2/2012 Griswold et al.
8,128,477 B2 * 3/2012 Durham et al. ..... 463/17
8,142,273 B2 3/2012 Williams et al.
8,192,281 B2 6/2012 Williams et al.
8,199,068 B2 6/2012 Williams et al.
8,210,922 B2 7/2012 Williams et al.
8,251,795 B2 * 8/2012 Durham et al. ..... 463/20
2001/0013681 A1 8/2001 Bruzzese et al.
2001/0016513 A1 8/2001 Muir et al.
2001/0031658 A1 10/2001 Ozaki et al.
2001/0035868 A1 11/2001 Uehara et al.
2002/0004421 A1 1/2002 Itai
2002/0015305 A1 2/2002 Bornhorst et al.
2002/0022518 A1 2/2002 Okuda et al.
2002/0045472 A1 4/2002 Adams
2002/0086725 A1 7/2002 Fasbender et al.
2002/0119035 A1 8/2002 Hamilton
2002/0142825 A1 10/2002 Lark et al.
2002/0167637 A1 11/2002 Burke et al.
2002/0173354 A1 11/2002 Winans et al.
2002/0175466 A1 11/2002 Loose et al.
2002/0183105 A1 12/2002 Cannon et al.
2002/0183109 A1 12/2002 McGahn et al.
2003/0026171 A1 2/2003 Brewer et al.
2003/0027624 A1 2/2003 Gilmore et al.
2003/0032478 A1 2/2003 Takahama et al.
2003/0032479 A1 2/2003 LeMay et al.
2003/0045345 A1 3/2003 Berman
2003/0060271 A1 3/2003 Gilmore et al.
2003/0064781 A1 4/2003 Muir
2003/0069063 A1 4/2003 Bilyeu et al.
2003/0087690 A1 5/2003 Loose et al.
2003/0128427 A1 7/2003 Kalmanash et al.
2003/0130026 A1 7/2003 Breckner et al.
2003/0130028 A1 7/2003 Aida et al.
2003/0148804 A1 8/2003 Ikeya et al.
2003/0157980 A1 8/2003 Loose et al.
2003/0176214 A1 9/2003 Burak et al.
2003/0199295 A1 10/2003 Vancura
2003/0220134 A1 11/2003 Walker et al.
2003/0234489 A1 12/2003 Okada
2003/0236114 A1 12/2003 Griswold et al.
2003/0236118 A1 12/2003 Okada
2004/0002372 A1 1/2004 Rodgers et al.
2004/0009803 A1 1/2004 Bennett et al.
2004/0023714 A1 2/2004 Asdale
2004/0029636 A1 2/2004 Wells
2004/0036218 A1 2/2004 Inoue
2004/0048645 A1 3/2004 Webb et al.
2004/0048673 A1 3/2004 Kaminkow
2004/0053660 A1 3/2004 Webb et al.
2004/0063490 A1 4/2004 Okada
2004/0066475 A1 4/2004 Searle
2004/0077404 A1 4/2004 Schlottmann et al.
2004/0102244 A1 5/2004 Kryuchkov et al.
2004/0102245 A1 5/2004 Escalera et al.
2004/0116178 A1 6/2004 Okada
2004/0142748 A1 * 7/2004 Loose et al. ..... 463/35
2004/0147303 A1 7/2004 Imura et al.
2004/0150162 A1 8/2004 Okada
2004/0162146 A1 8/2004 Ooto
2004/0166925 A1 8/2004 Emori et al.
2004/0166927 A1 8/2004 Okada
2004/0171423 A1 9/2004 Silva et al.
2004/0183251 A1 9/2004 Inoue
2004/0183972 A1 9/2004 Bell
2004/0192430 A1 9/2004 Burak et al.
2004/0198485 A1 10/2004 Loose et al.
2004/0207154 A1 10/2004 Okada
2004/0209666 A1 10/2004 Tashiro
2004/0209667 A1 10/2004 Emori et al.
2004/0209668 A1 10/2004 Okada
2004/0209671 A1 10/2004 Okada
2004/0209672 A1 10/2004 Okada
2004/0209678 A1 10/2004 Okada
2004/0209683 A1 10/2004 Okada
2004/0214635 A1 10/2004 Okada
2004/0214637 A1 10/2004 Nonaka
2004/0219967 A1 11/2004 Giobbi et al.
2004/0224747 A1 11/2004 Okada
2004/0227721 A1 11/2004 Moilanen et al.
2004/0233663 A1 11/2004 Emslie et al.
2004/0235558 A1 11/2004 Beaulieu et al.
2004/0239582 A1 12/2004 Seymour
2004/0266515 A1 * 12/2004 Gauselmann ..... 463/20
2004/0266536 A1 12/2004 Mattice et al.
2005/0020348 A1 1/2005 Thomas et al.
2005/0026673 A1 2/2005 Paulsen et al.
2005/0032571 A1 2/2005 Asonuma
2005/0037843 A1 2/2005 Wells et al.
2005/0049032 A1 3/2005 Kobayashi
2005/0049033 A1 3/2005 Kojima
2005/0049046 A1 3/2005 Kobayashi
2005/0052341 A1 3/2005 Henriksson
2005/0062410 A1 3/2005 Bell et al.
2005/0063055 A1 3/2005 Engel
2005/0079913 A1 4/2005 Inamura
2005/0085292 A1 4/2005 Inamura
2005/0145366 A1 7/2005 Erel
2005/0153772 A1 7/2005 Griswold et al.
2005/0153775 A1 7/2005 Griswold et al.
2005/0164786 A1 7/2005 Connelly
2005/0176493 A1 8/2005 Nozaki et al.
2005/0192090 A1 9/2005 Muir et al.
2005/0206582 A1 9/2005 Bell et al.
2005/0208994 A1 9/2005 Berman
2005/0233799 A1 10/2005 LeMay et al.
2005/0239539 A1 10/2005 Inamura
2005/0253775 A1 11/2005 Stewart
2005/0255908 A1 11/2005 Wells et al.
2005/0266912 A1 12/2005 Sekiguchi
2005/0285337 A1 12/2005 Durham et al.
2006/0025199 A1 2/2006 Harkins et al.
2006/0058100 A1 3/2006 Pacey et al.
2006/0063580 A1 3/2006 Nguyen et al.
2006/0073881 A1 4/2006 Pryzby et al.
2006/0100014 A1 5/2006 Griswold et al.
2006/0103951 A1 5/2006 Bell et al.
2006/0111179 A1 5/2006 Inamura
2006/0125745 A1 6/2006 Evanicky
2006/0148553 A1 * 7/2006 Dodge ..... 463/20
2006/0166727 A1 7/2006 Burak
2006/0191177 A1 8/2006 Engel
2006/0256033 A1 11/2006 Chan et al.
2006/0284574 A1 12/2006 Emslie et al.
2006/0290594 A1 12/2006 Engel et al.
2007/0004510 A1 1/2007 Underdahl et al.
2007/0004513 A1 1/2007 Wells et al.
2007/0010315 A1 1/2007 Hein
2007/0057866 A1 3/2007 Lee et al.
2007/0072665 A1 3/2007 Muir
2007/0077986 A1 4/2007 Loose
2007/0091011 A1 4/2007 Selbrede
2007/0105610 A1 * 5/2007 Anderson ..... 463/16
2007/0105611 A1 5/2007 O'Halloran
2007/0105628 A1 5/2007 Arbogast et al.
2007/0167208 A1 7/2007 Acres
2007/0252804 A1 11/2007 Engel
2008/0004104 A1 1/2008 Durham et al.
2008/0007486 A1 1/2008 Fujinawa et al.
2008/0020816 A1 1/2008 Griswold et al.
2008/0020839 A1 1/2008 Wells et al.
2008/0020840 A1 1/2008 Wells et al.
2008/0020841 A1 1/2008 Wells et al.
2008/0068290 A1 3/2008 Muklashy et al.
2008/0096655 A1 4/2008 Rasmussen et al.
2008/0108422 A1 5/2008 Hedrick et al.
2008/0113716 A1 5/2008 Beadell et al.
2008/0113745 A1 5/2008 Williams et al.
2008/0113746 A1 5/2008 Williams et al.
2008/0113748 A1 5/2008 Williams et al.
2008/0113756 A1 5/2008 Williams et al.
2008/0113775 A1 5/2008 Williams et al.
2008/0125219 A1 5/2008 Williams et al.
2008/0136741 A1 6/2008 Williams et al.
2008/0261674 A9 10/2008 Okada

| | | | |
|---|---|---|---|
| 2008/0284792 | A1 | 11/2008 | Bell |
| 2009/0036208 | A1 | 2/2009 | Pennington et al. |
| 2009/0061983 | A1 | 3/2009 | Kaufman et al. |
| 2009/0061984 | A1 | 3/2009 | Yi et al. |
| 2009/0069069 | A1 | 3/2009 | Crowder, Jr. et al. |
| 2009/0069070 | A1 | 3/2009 | Crowder, Jr. et al. |
| 2009/0079667 | A1 | 3/2009 | Schlottmann et al. |
| 2009/0082083 | A1 | 3/2009 | Wilson et al. |
| 2009/0091513 | A1 | 4/2009 | Kuhn |
| 2009/0104989 | A1 | 4/2009 | Williams et al. |
| 2009/0111577 | A1 | 4/2009 | Mead |
| 2009/0117993 | A1 | 5/2009 | Bigelow, Jr. et al. |
| 2009/0258697 | A1 | 10/2009 | Kelly et al. |
| 2009/0258701 | A1 | 10/2009 | Crowder, Jr. et al. |
| 2009/0280888 | A1 | 11/2009 | Durham et al. |
| 2009/0312095 | A1 | 12/2009 | Durham et al. |
| 2010/0045601 | A1 | 2/2010 | Engel et al. |
| 2010/0048288 | A1 | 2/2010 | Canterbury et al. |
| 2010/0115391 | A1 | 5/2010 | Engel et al. |
| 2010/0115439 | A1 | 5/2010 | Engel |
| 2010/0190545 | A1 | 7/2010 | Lauzon et al. |
| 2010/0214195 | A1 | 8/2010 | Ogasawara et al. |
| 2010/0234089 | A1 | 9/2010 | Saffari et al. |
| 2011/0065490 | A1 | 3/2011 | Lutnick et al. |
| 2011/0201404 | A1 | 8/2011 | Wells |
| 2011/0294562 | A1 | 12/2011 | Wilson et al. |
| 2012/0034975 | A1 | 2/2012 | Silva et al. |

FOREIGN PATENT DOCUMENTS

| | | | |
|---|---|---|---|
| CA | 2265283 | | 9/1999 |
| CA | 2428858 | | 5/2002 |
| CN | 1137651 | | 12/1996 |
| CN | 1208210 | | 2/1999 |
| EP | 0 454 423 | | 10/1991 |
| EP | 0 484 103 | | 5/1992 |
| EP | 0 860 807 | | 8/1998 |
| EP | 0 919 965 | | 6/1999 |
| EP | 0 997 857 | | 5/2000 |
| EP | 1 000 642 | | 5/2000 |
| EP | 1 260 928 | | 11/2002 |
| EP | 1 282 088 | | 2/2003 |
| EP | 1 369 830 | | 12/2003 |
| EP | 1 391 847 | | 2/2004 |
| EP | 1 462 152 | A2 | 9/2004 |
| EP | 1 465 126 | | 10/2004 |
| EP | 1 492 063 | | 12/2004 |
| EP | 1 571 626 | | 9/2005 |
| EP | 1 762 992 | | 3/2007 |
| EP | 1 826 739 | | 8/2007 |
| GB | 1 464 896 | | 2/1977 |
| GB | 2 120 506 | | 11/1983 |
| GB | 2 253 300 | | 9/1992 |
| GB | 2 316 214 | | 2/1998 |
| GB | 2 385 004 | | 8/2003 |
| JP | H02-90884 | | 7/1990 |
| JP | H03-20388 | | 2/1991 |
| JP | 04-220276 | | 8/1992 |
| JP | H05-68585 | | 9/1993 |
| JP | 06-043425 | | 2/1994 |
| JP | 07-124290 | | 5/1995 |
| JP | H10-015247 | | 1/1998 |
| JP | 10-234932 | | 9/1998 |
| JP | 11-000441 | | 1/1999 |
| JP | H11-137852 | | 5/1999 |
| JP | 2000-245963 | | 9/2000 |
| JP | 2000-300729 | | 10/2000 |
| JP | 2000-350805 | | 12/2000 |
| JP | 2000-354685 | | 12/2000 |
| JP | 2001-062032 | | 3/2001 |
| JP | 2001-238995 | | 9/2001 |
| JP | 2001-252393 | | 9/2001 |
| JP | 2001-252394 | | 9/2001 |
| JP | 2001-353254 | | 12/2001 |
| JP | 2002-085624 | | 3/2002 |
| JP | 2004-089707 | | 3/2004 |
| JP | 2004-105616 | | 4/2004 |
| JP | 2004-166879 | | 6/2004 |
| JP | 2004-350869 | | 12/2004 |
| JP | 2005-253561 | | 9/2005 |
| JP | 2005-266387 | | 9/2005 |
| JP | 2005-266388 | | 9/2005 |
| JP | 2005-274906 | | 10/2005 |
| JP | 2005-274907 | | 10/2005 |
| JP | 2005-283864 | | 10/2005 |
| JP | 2006-043425 | | 2/2006 |
| JP | 2006-059607 | | 3/2006 |
| JP | 2006346226 | | 12/2006 |
| JP | 2007-200869 | | 8/2007 |
| RU | 2 053 559 | | 1/1996 |
| RU | 2 145 116 | | 1/2000 |
| RU | 29794 | | 5/2003 |
| WO | WO 93/13446 | | 7/1993 |
| WO | 99/42889 | | 8/1999 |
| WO | 99/44095 | | 9/1999 |
| WO | WO 99/53454 | | 10/1999 |
| WO | WO 00/32286 | | 6/2000 |
| WO | 01/15127 | | 3/2001 |
| WO | 01/15128 | | 3/2001 |
| WO | 01/15132 | | 3/2001 |
| WO | WO 01/38926 | | 5/2001 |
| WO | 01/09664 | | 8/2001 |
| WO | WO 02/38234 | | 5/2002 |
| WO | WO 02/41046 | | 5/2002 |
| WO | WO 02/084637 | | 10/2002 |
| WO | WO 02/086610 | | 10/2002 |
| WO | WO 02/089102 | | 11/2002 |
| WO | WO 03/001486 | | 1/2003 |
| WO | WO 03/023491 | | 3/2003 |
| WO | WO 03/032058 | | 4/2003 |
| WO | 03/039699 | | 5/2003 |
| WO | WO 03/040820 | | 5/2003 |
| WO | PCT/NZ2003/00153 | | 7/2003 |
| WO | WO 03/079094 | | 9/2003 |
| WO | 04/001486 | | 12/2003 |
| WO | WO 04/001488 | | 12/2003 |
| WO | WO 04/002143 | | 12/2003 |
| WO | WO 2004/008226 | | 1/2004 |
| WO | WO 2004/023825 | | 3/2004 |
| WO | WO 2004/025583 | | 3/2004 |
| WO | WO 2004/036286 | | 4/2004 |
| WO | WO 2004/060512 | | 7/2004 |
| WO | WO 2004/079674 | | 9/2004 |
| WO | 2004/102520 | | 11/2004 |
| WO | WO 2005/071629 | | 8/2005 |
| WO | 2006/034192 | | 3/2006 |
| WO | 2006/038819 | | 4/2006 |
| WO | WO 2006/112740 | | 10/2006 |
| WO | WO 2007/040413 | | 4/2007 |
| WO | WO 2008/005278 | | 1/2008 |
| WO | WO 2008/028153 | | 3/2008 |
| WO | WO 2008/048857 | | 4/2008 |
| WO | WO 2008/061068 | | 5/2008 |
| WO | WO 2008/062914 | | 5/2008 |
| WO | WO 2008/063908 | | 5/2008 |
| WO | WO 2008/063914 | | 5/2008 |
| WO | WO 2008/063952 | | 5/2008 |
| WO | WO 2008/063956 | | 5/2008 |
| WO | WO 2008/063968 | | 5/2008 |
| WO | WO 2008/063969 | | 5/2008 |
| WO | WO 2008/063971 | | 5/2008 |
| WO | WO 2008/079542 | | 7/2008 |
| WO | WO 2009/029720 | | 3/2009 |
| WO | WO 2009/039245 | | 3/2009 |
| WO | WO 2009/039295 | | 3/2009 |
| WO | WO 2009/054861 | | 4/2009 |
| WO | WO 2010/023537 | | 3/2010 |
| WO | WO 2010/039411 | | 4/2010 |

OTHER PUBLICATIONS

Bosner, "How Smart Windows Work," HowStuffWorks, Inc.,www.howstuffworks.com, 1998-2004, 9 pages.

Exam Report dated Sep. 21, 2007 from European Application No. 05 705 315.9.

Novel 3-D Video Display Technology Developed, News release: Aug. 30, 1996, www.eurekalert.org/summaries/1199.html, printed from Internet Archive using date Sep. 2, 2000.

Saxe et al., "Suspended-Particle Devices," www.refr-spd.com, Apr./May 1996, 5 pages.
Time Multiplexed Optical Shutter (TMOS): A revolutionary Flat Screen Display Technology, www.vea.com/TMOS.html, Apr. 8, 1999, printed from Internet Archive using date Oct. 6, 1999.
Time Multiplexed Optical Shutter (TMOS): A revolutionary Flat Screen Display Technology, www.tralas.com/TMOS.html, Apr. 5, 2001, printed from Internet Archive using date Apr. 11, 2001.
U.S. Appl. No. 11/938,086, filed Nov. 9, 2007.
U.S. Appl. No. 11/877,611, filed Oct. 23, 2007.
Office Action dated Aug. 29, 2007 from U.S. Appl. No. 10/755,598.
Office Action dated Oct. 31, 2007 from U.S. Appl. No. 10/213,626.
Final Office Action dated Mar. 28, 2007 from U.S. Appl. No. 10/213,626.
Office Action dated Apr. 27, 2006 from U.S. Appl. No. 10/213,626.
Final Office Action dated Jan. 10, 2006 from U.S. Appl. No. 10/213,626.
Office Action dated Aug. 31, 2004 from U.S. Appl. No. 10/213,626.
International Search Report and Written Opinion mailed May 20, 2008 for PCT/US2007/084462.
"Light Valve". [online] [retrieved on Nov. 15, 2005]. Retrieved from the Internet URL http://www.meko.co.uk/lightvalve.shtml (1 page).
"Liquid Crystal Display". [online]. [retrieved on Nov. 16, 2005]. Retrieved form the Internet URL http://en.wikipedia.org/wiki/LCD (6 pages).
Bonsor, Kevin, "How Smart Windows Will Work," Howstuffworks, Inc. 1998-2002, http://www/howstuffworks.com/smart-window.htm/printable. Printed Nov. 25, 2002 (5 pages).
"What is SPD?" SPD Systems, Inc. 2002, http://www.spd-systems.com/spdq.htm. Printed Dec. 4, 2002 (2 pages).
"Debut of the Let's Make a Deal Slot Machine," Let's Make a Deal 1999-2002, http:///www.letsmakeadeal.com/pr01.htm. Printed Dec. 3, 2002 (2 pages).
U.S. Appl. No. 11/849,119, filed Aug. 31, 2007.
U.S. Appl. No. 11/858,849, filed Sep. 20, 2007.
U.S. Appl. No. 11/859,127, filed Sep. 21, 2007.
U.S. Appl. No. 11/938,184, filed Nov. 9, 2007.
U.S. Appl. No. 09/622,409, filed Nov. 6, 2000, Engel.
U.S. Appl. No. 12/849,284, filed Aug. 3, 2010, Silva.
U.S. Appl. No. 13/094,259, filed Apr. 26, 2011, Wells.
U.S. Appl. No. 13/027,260, filed Aug. 10, 2011, Wilson.
U.S. Appl. No. 13/443,770, filed Apr. 10, 2012, Frabbiele et al.
Third Party Submission for U.S. Appl. No. 13/207,260 dated Jan. 31, 2012.
Third Party Submission for U.S. Appl. No. 12/849,284 dated Apr. 9, 2012.
Third Party Submission filed for U.S. Appl. No. 13/094,259 dated Oct. 18, 2011.
PCT International Search Report dated Apr. 9, 2008 issued in WO 2008/028153.
PCT Written Opinion dated Apr. 9, 2008 issued in WO 2008/028153.
PCT International Preliminary Report on Patentability and Written Opinion dated Mar. 3, 2009 issued in WO 2008/028153.
Australian Examiner's first report dated Jul. 25, 2011 issued in AU 2007289050.
European Examination Report dated Oct. 5, 2009 issued in EP 07 814 629.7.
PCT International Search Report dated Dec. 7, 2009 issued in WO 2010/039411.
PCT International Search Report dated May 25, 2005 issued in WO 2005/071629.
PCT Written Opinion dated May 25, 2005 issued in WO 2005/071629.
PCT International Preliminary Report on Patentability and Written Opinion dated Jul. 17, 2006 issued in WO 2005/071629.
Australian Examiner's First Report dated Nov. 12, 2009 issued in AU2005207309.
Australian Examiner's Report No. 2 dated Sep. 15, 2010 issued in AU Application No. 2005207309.
Canadian Office Action dated Sep. 10, 2012 issued in CA 2,553,321.
Chinese First Office Action dated Nov. 28, 2008 issued in CN2005800022940.
Chinese Second Office Action dated Sep. 25, 2009 issued in CN2005800022940.
Chinese Third Office Action dated May 11, 2010 issued in CN2005800022940.
Mexican Office Action (as described by foreign attorney) dated Jun. 18, 2009 issued for MX 06/07950.
Russian Examination and Resolution on Granting Patent dated Jul. 18, 2008 issued in RU 2006-128289-09.
PCT International Search Report dated May 2, 2008 issued in WO 2008/061068.
PCT Written Opinion dated May 2, 2008 issued in WO 2008/061068.
PCT International Preliminary Report on Patentability and Written Opinion dated May 12, 2009 issued in WO 2008/061068.
Australian Examiner's first report dated Jul. 7, 2011 issued in AU 2007319331.
EP Examination Report dated Oct. 28, 2009 issued in EP 07 845 059.0 1238.
PCT International Search Report dated May 20, 2008 issued in WO 2008/063952.
PCT International Search Report and Written Opinion dated May 20, 2008 issued in WO 2008/063952.
PCT International Preliminary Report on Patentability and Written Opinion dated May 19, 2009 issued in WO 2008/063952.
Australian Examiner's first report dated Aug. 2, 2011 issued in AU 2007323945.
Australian Examiner's report No. 2 dated Feb. 10, 2012 issued in AU 2007323945.
European Examination Report dated Oct. 28, 2009 issued in EP 07 864 281.6.
PCT International Search Report dated Dec. 18, 2008 issued in WO 2009/039245.
PCT Written Opinion dated Dec. 18, 2008 issued in WO 2009/039245.
PCT International Preliminary Report on Patentability and Written Opinion dated Mar. 24, 2010 issued in WO 2009/039245.
PCT International Search Report dated May 7, 2008 issued in WO 2008/063914.
PCT Written Opinion dated May 7, 2008 issued in WO 2008/063914.
PCT International Preliminary Examination Report on Patentability and Written Opinion dated May 19, 2009 issued in WO 2008/063914.
Australian Examiner's first report dated Jul. 25, 2011 issued in AU 2007324000.
Australian Patent Examination Report No. 2 dated Jul. 31, 2012 issued in AU 2007324000.
European Examination Report dated Oct. 28, 2009 issued in EP 07 844 998.0.
PCT International Search Report dated May 14, 2008 issued in WO 2008/063956.
PCT Written Opinion dated May 14, 2008 issued in WO 2008/063956.
PCT International Preliminary Report on Patentability and Written Opinion dated May 19, 2009 issued in WO 2008/063956.
Australian Examiner's First Report dated Aug. 4, 2011 issued in AU 2007323949.
Australian Patent Examination Report No. 2 dated Jun. 27, 2012 issued in AU 2007323949.
Australian Patent Examination Report No. 3 dated Aug. 23, 2012 issued in AU 2007323949.
PCT International Search Report dated May 8, 2008 issued in issued in WO 2008/063908.
PCT Written Opinion dated May 8, 2008 issued in issued in WO 2008/063908.
PCT International Preliminary Report on Patentability and Written Opinion dated May 19, 2009 issued in WO 2008/063908.
Australian Examiner's first report dated Jul. 25, 2011 issued in AU 2007323994.
PCT International Search Report dated Jun. 11, 2008 issued in WO 2008/079542.
PCT Written Opinion dated Jun. 11, 2008 issued in WO 2008/079542.
PCT International Preliminary Report on Patentability and Written Opinion dated May 19, 2009 issued in WO 2008/079542.

Australian Examiner's first report dated Aug. 2, 2011 issued in AU 2007338512.
European Examination Report dated Oct. 28, 2009 issued in EP 07 872 343.4.
PCT International Preliminary Report on Patentability and Written Opinion dated May 19, 2009 issued in WO 2008/063971.
Australian Examiner's first report dated Aug. 2, 2011 issued in AU 2007323964.
Australian Patent Examination Report No. 2 dated Jul. 11, 2012 issued in AU 2007323964.
PCT International Search Report dated Dec. 11, 2008 issued in PCT/US2008/076881 [WO 2009/039295].
PCT Written Opinion dated Dec. 11, 2008 issued in PCT/US2008/076881 [WO 2009/039295].
PCT International Preliminary Report on Patentability and Written Opinion dated Mar. 24, 2010 issued in PCT/US2008/076881 [WO 2009/039295].
PCT International Search Report dated Jul. 16, 2008 issued in WO2009/054861.
PCT Written Opinion dated Jul. 16, 2008 issued in WO2009/054861.
PCT International Preliminary Report on Patentability and Written Opinion dated Apr. 27, 2010 issued in WO 2009/054861.
Australian Examiner's First Report dated Sep. 22, 2005 issued in AU 29246/02.
Australian Notice of Opposition by Aristocrat Technologies dated Apr. 8, 2009 issued in AU 2007200982.
Australian Statement of Grounds and Particulars in Support of Opposition by Aristocrat Technologies dated Jul. 6, 2009 issued in AU 2007200982.
Australian Withdrawal of Opposition by Aristocrat Technologies dated Aug. 12, 2009 issued in AU 2007200982.
PCT International Search Report and Written Opinion dated May 9, 2008 issued in for WO 2008/048857.
PCT Written Opinion dated May 9, 2008 issued in WO 2008/048857.
PCT International Preliminary Report on Patentability and Written Opinion dated Apr. 15, 2009 issued in WO2008/048857.
Australian Examiner's first report dated Nov. 30, 2011 issued in AU2007312986.
European Examination Report dated Sep. 10, 2009 issued in EP 07 853 965.7.
European Examination Report dated Oct. 28, 2009 issued in EP 07 845 062.4.
PCT International Search Report dated May 20, 2008 issued in WO2008/063969.
PCT Written Opinion dated May 20, 2008 issued in WO 2008/063969.
PCT International Preliminary Report on Patentability and Written Opinion dated May 19, 2009 issued in WO 2008/063969.
Australian Examiner's first report dated Aug. 19, 2011 issued in AU2007323962.
Australian Examiner's report No. 2 dated Feb. 24, 2012 issued in AU2007323962.
PCT International Search Report dated Jul. 21, 2008 issued in WO 2008/063968.
PCT Written Opinion dated Jul. 21, 2008 issued in WO 2008/063968.
PCT International Preliminary Report on Patentability and Written Opinion dated May 19, 2009 issued in WO 2008/063968.
Australian Examiner's first report dated Jul. 29, 2011 issued in AU 2007323961.
European Examination Report dated Oct. 28, 2009 issued in EP 07 854 617.3.
PCT International Search Report dated Jun. 15, 2004 issued in WO 2004/07974.
PCT International Preliminary Report on Patentability and Written Opinion dated Sep. 2, 2005 issued in WO 2004/07974.
Australian Examiner's First Report dated May 17, 2007 issued in AU 2004216952.
Australian Examiner's Report No. 2 dated Jul. 30, 2007 issued in AU 2004216952.
Australian Examiner's Report No. 3 dated May 28, 2008 issued in AU 2004216952.
Japanese Description of Office Action dated Jul. 4, 2006 issued in Application No. 2005-518567.
Japanese Description of Office Action Final dated Apr. 10, 2007 issued in Application No. 2005-518567.
Japanese Description of Office Action (interrogation) dated May 25, 2009 issued by an Appeal Board in Application No. 2005-518567.
European Extended Search Report dated Jan. 26, 2012 issued in EP 11 17 6202.
European Communication dated Mar. 5, 2012 issued in EP 11 17 6202.
GB Combined Search and Examination Report dated Nov. 18, 2011 issued in GB1113207.3.
Australian Examiner's First Report dated Apr. 5, 2005 issued in AU2003227286.
Australian Examination Report (as described by Applicant's Attorney) dated Feb. 26, 2009 issued in AU2003227286.
Australian Re-Examination Report dated May 1, 2009 issued in AU2003227286.
Australian Examiner Communication regarding Claims dated Nov. 24, 2009 issued in AU2003227286.
Australian Notice of Acceptance with Exam Comments dated Jan. 28, 2010 issued in AU2003227286.
Australian Examiner's First Report dated Jul. 23, 2007 issued in AU2006203570.
Australian Notice of Acceptance with Examiner's Comments dated Nov. 15, 2007 issued in AU2006202570.
Australian Re-Examination Report (No. 1) dated Dec. 2, 2009 issued in AU2006203570.
Australian Examiner Communication dated Feb. 5, 2010 issued in AU 2006203570.
Australian Re-Examination Report (No. 2) dated Feb. 8, 2010 issued in AU 2006203570.
Bonser, Kevin (2004) "How Smart Windows Work," *HowStuffWorks, Inc.*, 1998-2004, retrieved from the Internet on Apr. 1, 2004 at http://www.howstuffworks.com, 9 pgs.
Debut of the Let's Make a Deal Slot Machine (2002), *The Official Let's Make a Deal Website at* www.letsmakeadeal.com, 1999-2002, modified Jan. 2, 2002; downloaded from Internet on Dec. 3, 2002 at http:///www.letsmakeadeal.com/pr01.htm, 2 pgs.
"Living in a flat world?" Deep Video Imaging Ltd. Marketing Brochure, published in 2000 (full date unknown), 8 pgs.
Newton, Harry, Newton's Telecom Dictionary, Jan. 1998, Telecom Books and Flatiron Publishing, p. 399.
"Pointer_Ballistics for Windows XP.pdf" (Oct. 31, 2002), *Microsoft*, [downloaded on Aug. 27, 2010 from http://www.microsoft.com/whdc/archive/pointer-bal.mspx], 3 pages.
Police 911, *Wikipedia*, Jan. 22, 2002, retrieved from Internet at http://en.wilkipedia.org/widi/Police_911 on Oct. 28, 2007, 4 pgs.
Stic Search History, Patent Literature Bibliographic Databases, in a US Office Action dated Jul. 23, 2010 issued in U.S. Appl. No. 11/938,151, 98 pages.
EP Office Action dated Oct. 28, 2009 issued in Application No. 07845062.4.

* cited by examiner

MULTIMEDIA EMULATION OF PHYSICAL REEL HARDWARE IN PROCESSOR-BASED GAMING MACHINES

CROSS REFERENCE TO RELATED APPLICATION

This application claims priority to U.S. Provisional Patent Application No. 60/858,741, filed on Nov. 13, 2006, which is incorporated herein by reference in its entirety and for all purposes.

TECHNICAL FIELD

The present invention relates generally to wager based gaming machines, and more specifically to the multimedia emulation of physical reel hardware on processor-based gaming machines.

BACKGROUND

A "mechanical reel" type gaming machine can refer to a slot machine having traditional physical rotating reels with their associated latches and mechanical parts. A mechanical reel usually has a fixed number of reel symbols disposed about a reel strip attached about the circumference of a wheel. In a pure mechanical gaming machine, a motor, spring, or other mechanical system physically rotates or spins the wheel or reel until it stops at a particular rotational position or "reel stop," and a particular reel symbol rests in view of a player to indicate an outcome for that reel for that given reel game. In many older machines, the reels were spun by potential energy first stored in a spring-loaded mechanism wound and then actuated by the pull of a traditional pull-arm handle. Each reel was stopped at a random position by a mechanical device. The slot machine sensed a combined reel outcome, usually along a central payline, by sensing the physical position of each reel. A payout could then be made to the player if the combined outcome was a winning combination.

Later versions of such gaming machines include "electromechanical" reel type gaming machines. Such electromechanical reel type gaming machines could include the same or similar physical rotating reels, with the starting, spinning and stopping of each such electromechanical reel being controlled by a stepper motor. One or more microprocessors are used to control the various reel stepper motors. The use of microprocessors and stepper motors generally allows for a wide expansion of "virtual" reel stops for each rotating reel, such that larger payouts and jackpots can be realized over purely mechanical reel type gaming machines. Although these electromechanical reel type gaming machines do use processors to some degree, the use of clearly physical reels for wagering games is appealing to many players. In fact, there are many gaming machine players who tend to play only or mostly on gaming machines that have physical reels.

Although popular throughout recent history, these mechanically driven reel slot machines are being steadily replaced by electronic gaming machines, some of which are specifically adapted to simulate such reel based games on a video display, such as a cathode-ray tube, liquid crystal display ("LCD"), flat panel display or the like. Processor-based gaming machines are becoming the norm. One reason for their increased popularity is the nearly endless variety of games that can be implemented using processor-based technology. These processor-based gaming machines permit the operation of more complex games, advance player tracking, improve security, permit wireless communications, and add a host of digital features that are not possible on the traditional mechanical and electromechanical reel type gaming machines.

In a typical electronic gaming machine, such as a processor-based gaming machine adapted to simulated multiple rotating reels, a game play is initiated through a player wager of money or credit, whereupon the gaming machine determines a game outcome, presents the game outcome to the player and then potentially dispenses an award of some type, including a monetary award, depending upon the game outcome. Electronic and microprocessor based gaming machines can include a variety of hardware and software components to provide a wide variety of game types and game playing capabilities, with such hardware and software components being generally well known in the art. A typical electronic gaming machine can include hardware devices and peripheral such as bill validators, coin acceptors, card readers, keypads, buttons, levers, touch screens, coin hoppers, player tracking units and the like. In addition, each gaming machine can have various audio and visual display components that can include, for example, speakers, display panels, belly and top glasses, exterior cabinet artwork, lights, and top box dioramas, as well as any number of video displays of various types to show game play and other assorted information.

Advances in technology have resulted in processor-based gaming machines that are increasingly better at emulating actual mechanical reels from a mechanical or electromechanical reel-based gaming machine. Various efforts to simulate or realistically emulate mechanical reels on a video screen of a processor-based gaming machine abound. Some of such efforts can be found at, for example, U.S. Pat. No. 6,887,157, entitled "Virtual Camera and 3-D Gaming Environments in a Gaming Machine," as well as at Japanese Patent Publication No. 2006346226A2, entitled "Game Device and Game Program." Another reference that involves rotating reel games having processors is U.S. Patent Publication No. 2005/0285337, entitled "Dynamic Generation of a Profile for Spinning Reel Gaming Machines," and there are numerous other known instances of machines and systems involving rotating reel games that are controlled at least in part by a microprocessor.

While existing designs and systems for providing realistic reel games on processor-based gaming machines, and particularly the presentation of spinning reels on the video displays thereof, have been adequate in the past, improvements are usually welcomed and encouraged. In light of the foregoing, it is thus desirable to develop improved processor-based gaming machines that provide even better emulation of physical reels for reel based games played thereupon.

SUMMARY

It is an advantage of the present invention to provide processor-based gaming machines that are adapted to present realistic emulations of reel-based games thereupon, such that the simulated gaming reels are more appealing to players. This can be accomplished at least in part through the use of simulated or "virtual" gaming reels that are presented based upon recorded samplings of actual physical reels. It is an additional advantage of the present invention to provide separate audio channels for the purpose of emulating physical reel sounds, which emulating sounds may be presented in stereo and/or may provide haptic feedback for added realistic effects.

In various embodiments of the present invention, a processor-based gaming machine adapted for accepting a wager, playing a game based on the wager and granting a payout based on the result of the game is provided. Such a gaming machine can include an exterior housing arranged to contain various internal gaming machine components therein, a master gaming controller in communication with various internal gaming machine components and adapted to execute or control one or more aspects of the wager based game, a display device in communication with the master gaming controller and adapted to present a plurality of simulated rotating reels, and one or more speakers in communication with the master gaming controller and adapted to present sounds with respect to the simulated rotating reels.

The processor-based gaming machine can also include a reel spin timer in communication with the master gaming controller and/or display device, with such a reel spin timer being adapted to vary the spin times of the simulated rotating reels from one game play to another. The processor-based gaming machine can also include a reel sound generator in communication with the master gaming controller and/or one or more speakers, with such a reel sound generator being adapted to provide sounds to one or more speakers with respect to the simulated rotating reels, wherein the provided sounds vary from one game play to another.

In various embodiments, a wager-based gaming system having a plurality of processor-based gaming machines is provided. Such processor-based gaming machines can include any of those recited herein having virtual or simulated rotating reels. The wager-based gaming system can also include a remote host in communication with each of the processor-based gaming machines, with the remote host being adapted to download reel spin times and/or reel sounds to the networked gaming machines. The wager-based gaming system can also include at least one reel spin timer and/or reel sound generator in communication with the remote host, the gaming machines or both. A reel spin timer and/or reel sound generator can be located at the remote host, within one or more of the gaming machines, or both.

Further features and items may also be found in any of the foregoing embodiments, and it will be readily appreciated that various combinations of the following features and items may be used. For example, the display device can comprise a multi-layer display having a plurality of display screens positioned front to back with respect to each other. In addition, the speakers can comprise a plurality of dedicated reel speakers located in close proximity to the display of the simulated rotating reels. In some embodiments, each of the dedicated reel speakers corresponds to one simulated rotating reel, and in some embodiments, the dedicated reel speakers are collectively adapted to present stereophonic sounds with respect to the simulated rotating reels.

In various embodiments, the reel spin timer can be adapted to vary spin times from one game play to another based upon random selections from a plurality of acceptable spin times. Such acceptable spin times can be based upon sampling actual physical reels from a mechanical or electromechanical reel-type gaming machine. In various embodiments, the reel sound generator can be adapted to vary the provided sounds from one game play to another based upon random selections from one or more stored sound files. Such stored sound files can similarly be based upon sampling actual physical reels from a mechanical or electromechanical reel-type gaming machine. Various storage devices can be associated with the reel spin timer, reel sound generator, or both. The processor-based gaming machine can also include a network interface coupling the gaming machine to one or more remotely located networked components, with such a network interface adapted to facilitate the downloading of reel spin times, reel sounds, or both to the gaming machine.

In further embodiments, various methods of presenting simulated reels on a processor-based gaming machine may also be provided. Such methods can include a first step of displaying on a display device of the processor-based gaming machine a plurality of simulated reels in a static, non-rotating position. Additional steps can include accepting a monetary value wager from a player, accepting a game-related input from the player and initiating the play of a wager-based game as a result of the game-related input. Further method steps can involve determining reel spin times for each of the simulated reels, with such reel spin times varying from one game play to another of reel-type games on said processor-based gaming machine, and then presenting on the display the simulated reels in rotational motion, wherein such presentation is based at least in part on the determined reel spin times for each of the simulated reels. Additional steps can include generating reel sounds for each of the simulated reels, with such reel sounds varying from one game play to another, and also presenting these generated reel sounds on one or more speakers of the processor-based gaming machine.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and process steps for the disclosed inventive gaming reels and methods of presentation therefor.

DETAILED DESCRIPTION

Exemplary applications of apparatuses and methods according to the present invention are described as follows. These examples are being provided solely to add context and aid in the understanding of the invention. It will be apparent to one skilled in the art that the present invention may be practiced without some or all of these specific details. In other instances, well known process steps have not been described in detail in order to avoid unnecessarily obscuring the present invention. Other applications are possible, such that the following examples should not be taken as definitive or limiting in scope or setting. Although these examples are described in sufficient detail to enable one skilled in the art to practice the invention, it will be understood that they are not limiting, such that other embodiments may be used and changes may be made without departing from the spirit and scope of the invention.

Described herein are various processor-based gaming machines and systems that realistically emulate physical rotating reels, such as those from a mechanical or electromechanical reel based slot machine. It will be understood that when the term actual "physical" reels or the like is used herein without particularized context, that such a term can refer to purely mechanical reels, electromechanical stepper based reels, or both. The disclosed processor-based gaming machines can include a number of realistic adaptations, such as audio, video and/or physical adaptations, where each contributes to the perception of actual physical reels from a reel slot machine. Such gaming machines and systems can include a specialized multi-layer display, a specialized reel spin timer, a specialized reel sound generator, and/or one or more specialized speakers adapted to present emulated physical reel sounds, which sounds may be presented in stereo for added effect. Such components may be implemented and used individually or in various combinations, as desired.

Gaming Machines

Figure 1:
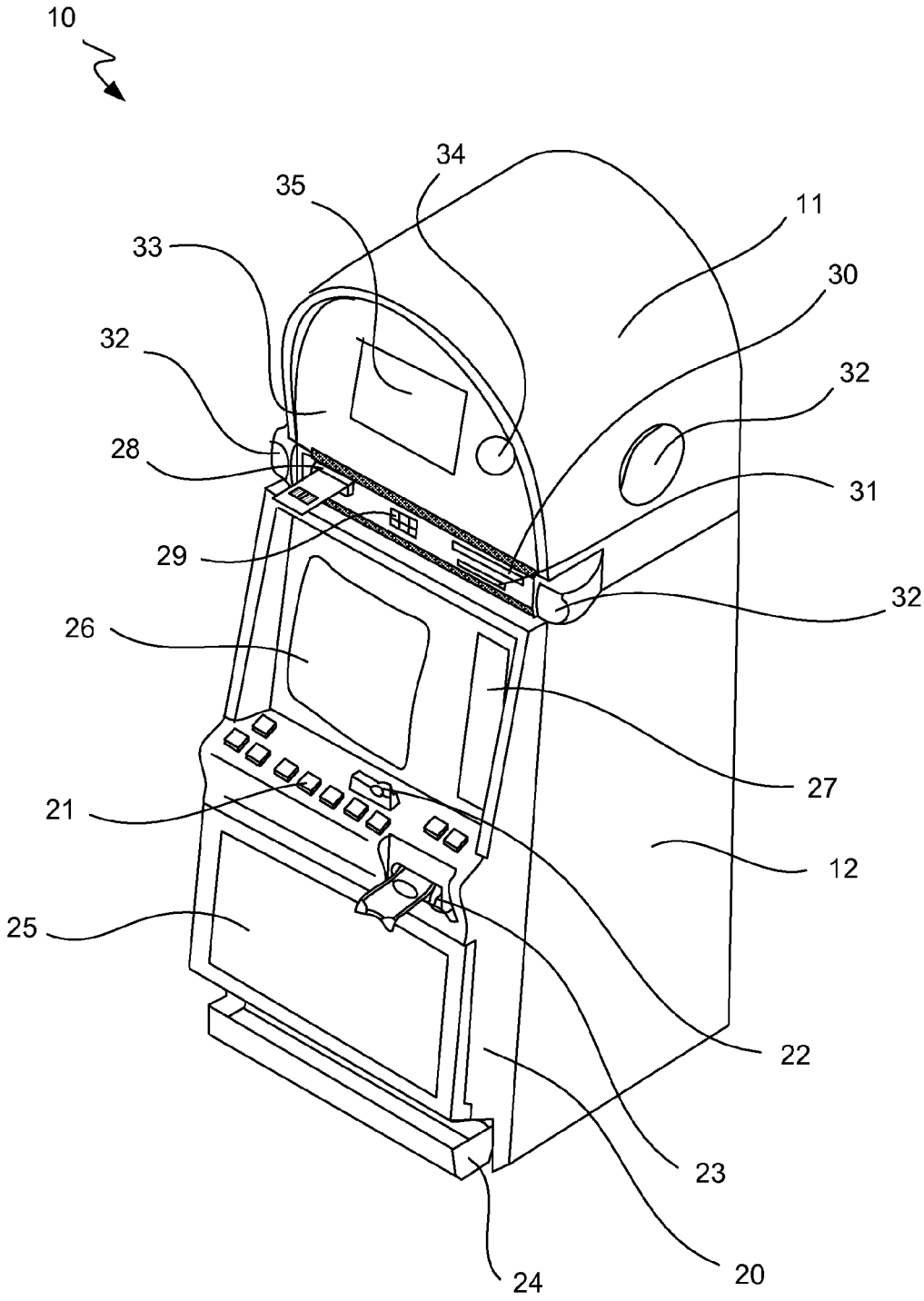
FIG. 1 illustrates in perspective view an exemplary gaming machine.

Referring first to FIG. 1, an exemplary processor-based gaming machine is illustrated in perspective view. Gaming machine 10 includes a top box 11 and a main cabinet 12, which generally surrounds the machine interior (not shown) and is viewable by users. This top box and/or main cabinet can together or separately form an exterior housing adapted to contain a plurality of internal gaming machine components therein. Main cabinet 12 includes a main door 20 on the front of the gaming machine, which preferably opens to provide access to the gaming machine interior. Attached to the main door are typically one or more player-input switches or buttons 21, which collectively form a button panel, one or more money or credit acceptors, such as a coin acceptor 22 and a bill or ticket validator 23, a coin tray 24, and a belly glass 25. Viewable through main door 20 is a primary video display monitor 26 adapted to present a game and one or more information panels 27. The primary video display monitor 26 will typically be a cathode ray tube, high resolution flat-panel LCD, plasma/LED display or other conventional or other type of appropriate video monitor. Alternatively, a plurality of gaming reels can be used as a primary gaming machine display in place of display monitor 26, with such gaming reels preferably being electronically controlled, as will be readily appreciated by one skilled in the art.

Top box 11, which typically rests atop of the main cabinet 12, may contain a ticket dispenser 28, a key pad 29, one or more additional displays 30, a card reader 31, one or more speakers 32, a top glass 33, one or more cameras 34, and a secondary video display monitor 35, which can similarly be a cathode ray tube, a high resolution flat-panel LCD, a plasma/LED display or any other conventional or other type of appropriate video monitor. Alternatively, secondary display monitor 35 might also be foregone in place of other displays, such as gaming reels or physical dioramas that might include other moving components, such as, for example, one or more movable dice, a spinning wheel or a rotating display. It will be understood that many makes, models, types and varieties of gaming machines exist, that not every such gaming machine will include all or any of the foregoing items, and that many gaming machines will include other items not described above. In particular, gaming machine 10 can be any of a wide variety of gaming machines manufactured and/or distributed by International Game Technology of Reno, Nev. ("IGT").

With respect to the basic gaming functionalities provided, it will be readily understood that gaming machine 10 can be adapted for presenting and playing any of a number of gaming events, particularly games of chance involving a player wager and potential monetary payout, such as, for example, a wager on a sporting event or general play as a slot machine game, a keno game, a video poker game, a video blackjack game, and/or any other video table game, among others. Other features and functions may also be used in association with gaming machine 10, and it is specifically contemplated that the present invention can be used in conjunction with such a gaming machine or device that might encompass any or all such additional types of features and functions. In various preferred embodiments, gaming machine 10 can be adapted to present a video simulation of a reel based slots game involving a plurality of gaming reels.

With respect to electronic gaming machines in particular, the electronic gaming machines made by IGT are provided with special features and additional circuitry that differentiate them from general-purpose computers, such as a laptop or desktop personal computer ("PC"). Because gaming machines are highly regulated to ensure fairness, and in many cases are operable to dispense monetary awards of millions of dollars, hardware and software architectures that differ significantly from those of general-purpose computers may be implemented into a typical electronic gaming machine in order to satisfy security concerns and the many strict regulatory requirements that apply to a gaming environment. A general description of many such specializations in electronic gaming machines relative to general-purpose computing machines and specific examples of the additional or different components and features found in such electronic gaming machines will now be provided.

At first glance, one might think that adapting PC technologies to the gaming industry would be a simple proposition, since both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

Accordingly, one difference between gaming machines and common PC based computers or systems is that gaming machines are designed to be state-based systems. In a state-based system, the system stores and maintains its current state in a non-volatile memory, such that in the event of a power failure or other malfunction the gaming machine will return to its current state when the power is restored. For instance, if a player were shown an award for a game of chance and the power failed before the award was provided, the gaming machine, upon the restoration of power, would return to the state where the award was indicated. As anyone who has used a PC knows, PCs are not state machines, and a majority of data is usually lost when a malfunction occurs. This basic requirement affects the software and hardware design of a gaming machine in many ways.

A second important difference between gaming machines and common PC based computer systems is that for regulation purposes, the software on the gaming machine used to generate the game of chance and operate the gaming machine must be designed as static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulator in a particular jurisdiction and installed in the presence of a person representing the gaming jurisdiction. Any change to any part of the software required to generate the game of chance, such as, for example, adding a new device driver used by the master gaming controller to operate a device during generation of the game of chance, can require a new EPROM to be burnt, approved by the gaming jurisdiction, and reinstalled on the gaming machine in the presence of a gaming regulator. Regardless of whether the EPROM solution is used, to gain approval in most gaming jurisdictions, a gaming machine must demonstrate sufficient safeguards that prevent an operator of the gaming machine from manipulating hardware and software in a manner that gives the operator an unfair or even illegal advantage over a player. The code validation requirements in the gaming industry affect both hardware and software designs on gaming machines.

A third important difference between gaming machines and common PC based computer systems is that the number and kinds of peripheral devices used on a gaming machine are not as great as on PC based computer systems. Traditionally in the gaming industry, gaming machines have been relatively simple in the sense that the number of peripheral devices and the number of functions on the gaming machine have been limited. Further, the functionality of a gaming machine tends to remain relatively constant once the gaming machine is deployed, in that new peripheral devices and new gaming software is infrequently added to an existing operational gaming machine. This differs from a PC, where users tend to buy new and different combinations of devices and software from different manufacturers, and then connect or install these new items to a PC to suit their individual needs. Therefore, the types of devices connected to a PC may vary greatly from user to user depending on their individual requirements, and may also vary significantly over time for a given PC.

Although the variety of devices available for a PC may be greater than on a gaming machine, gaming machines still have unique device requirements that differ from a PC, such as device security requirements not usually addressed by PCs. For instance, monetary devices such as coin dispensers, bill validators, ticket printers and computing devices that are used to govern the input and output of cash to a gaming machine have security requirements that are not typically addressed in PCs. Many PC techniques and methods developed to facilitate device connectivity and device compatibility do not address the emphasis placed on security in the gaming industry. To address some of these issues, a number of hardware/software components and architectures are utilized in gaming machines that are not typically found in general-purpose computing devices, such as PCs. These hardware/software components and architectures include, but are not limited to, items such as watchdog timers, voltage monitoring systems, state-based software architectures and supporting hardware, specialized communication interfaces, security monitoring, and trusted memory.

A watchdog timer is normally used in IGT gaming machines to provide a software failure detection mechanism. In a normal operating system, the operating software periodically accesses control registers in a watchdog timer subsystem to "re-trigger" the watchdog. Should the operating software not access the control registers within a preset timeframe, the watchdog timer will time out and generate a system reset. Typical watchdog timer circuits contain a loadable timeout counter register to allow the operating software to set the timeout interval within a certain time range. A differentiating feature of some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the associated computer system may result. Though most modern general-purpose computers include voltage-monitoring circuitry, these types of circuits only report voltage status to the operating software. Out of tolerance voltages can cause software malfunction, creating a potential unanticipated and/or undesirable condition in the gaming computer. IGT gaming machines, however, typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT gaming machine game software is to use a state machine. Each function of the game (e.g., bet, play, result) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, or the like. This is critical to ensure that correct wagers and credits are preserved. Typically, battery backed RAM devices are used to preserve this critical data. These memory devices are not used in typical general-purpose computers. Further, IGT gaming computers normally contain additional interfaces, including serial interfaces, to connect to specific subsystems internal and external to the gaming machine. The serial devices may have electrical interface requirements that differ from the "standard" EIA RS232 serial interfaces provided by general-purpose computers. These interfaces may include EIA RS485, EIA RS422, USB, Fiber Optic Serial, optically coupled serial interfaces, current loop style serial interfaces, and the like. In addition, to conserve serial interfaces internally in the gaming machine, serial devices may be connected in a shared, daisy-chain fashion where multiple peripheral devices are connected to a single serial channel.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this. In addition, security-monitoring circuits detect intrusion into an IGT gaming machine by monitoring security switches attached to access doors in the gaming machine cabinet. Preferably, access violations result in suspension of game play and can trigger additional security operations to preserve the current state of game play. These circuits also function when power is off by use of a battery backup. In power-off operation, these circuits continue to monitor the access doors of the gaming machine. When power is restored, the gaming machine can determine whether any security violations occurred while power was off, such as by software for reading status registers. This can trigger event log entries and further data authentication operations by the gaming machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the gaming machine. The code and data stored in these devices may include, for example, authentication algorithms, random number generators, authentication keys, operating system kernels, and so forth. The purpose of these trusted memory devices is to provide gaming regulatory authorities a root trusted authority within the computing environment of the gaming machine that can be tracked and verified as original. This may be accomplished via removal of the trusted memory device from the gaming machine computer and verification of the secure memory device contents is a separate third party verification device. Once the trusted memory device is verified as authentic, and based on the approval of verification algorithms contained in the trusted device, the gaming machine is allowed to verify the authenticity of additional code and data that may be located in the gaming computer assembly, such as code and data stored on hard disk drives.

Mass storage devices used in a general-purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present. In addition to the basic gaming abilities provided, these and other features and functions serve to differentiate gaming machines into a special class of computing devices separate and distinct from general-purpose computers.

General Gaming Network and System Configurations

Figure 2:
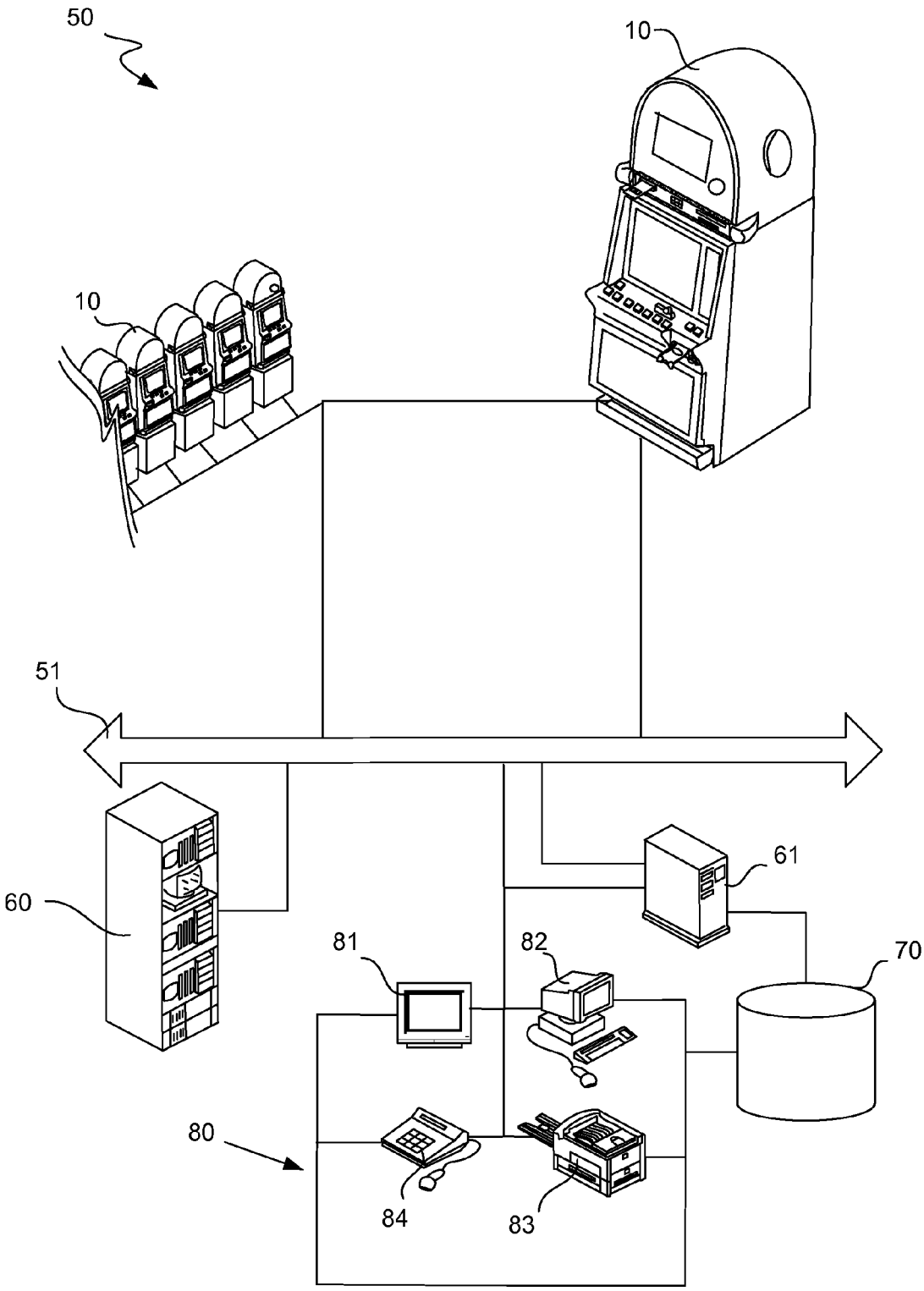
FIG. 2 illustrates in block diagram format an exemplary network infrastructure for providing a gaming system having one or more gaming machines.

Continuing with FIG. 2, an exemplary network infrastructure for providing a gaming system having one or more gaming machines is illustrated in block diagram format. Exemplary gaming system 50 has one or more gaming machines, various communication items, and a number of host-side components and devices adapted for use within a gaming environment. As shown, one or more gaming machines 10 adapted for use in gaming system 50 can be in a plurality of locations, such as in banks on a casino floor or standing alone at a smaller non-gaming establishment, as desired. Common bus 51 can connect one or more gaming machines or devices to a number of networked devices on the gaming system 50, such as, for example, a general-purpose server 60, one or more special-purpose servers 61, a sub-network of peripheral devices 80, and/or a database 70.

A general-purpose server 60 may be one that is already present within a casino or other establishment for one or more other purposes beyond any monitoring or administering involving gaming machines. Functions for such a general-purpose server can include other general and game specific accounting functions, payroll functions, general Internet and e-mail capabilities, switchboard communications, and reservations and other hotel and restaurant operations, as well as other assorted general establishment record keeping and operations. In some cases, specific gaming related functions such as cashless gaming, downloadable gaming, player tracking, remote game administration, video or other data transmission, or other types of functions may also be associated with or performed by such a general-purpose server. For example, such a server may contain various programs related to cashless gaming administration, player tracking operations, specific player account administration, remote game play administration, remote game player verification, remote gaming administration, downloadable gaming administration, and/or visual image or video data storage, transfer and distribution, and may also be linked to one or more gaming machines, in some cases forming a network that includes all or many of the gaming devices and/or machines within the establishment. Communications can then be exchanged from each adapted gaming machine to one or more related programs or modules on the general-purpose server.

In one embodiment, gaming system 50 contains one or more special-purpose servers that can be used for various functions relating to the provision of cashless gaming and gaming machine administration and operation under the present methods and systems. Such a special-purpose server or servers could include, for example, a cashless gaming server, a player verification server, a general game server, a downloadable game server, a specialized accounting server, and/or a visual image or video distribution server, among others. Of course, these functions may all be combined onto a single specialized server. Such additional special-purpose servers are desirable for a variety of reasons, such as, for example, to lessen the burden on an existing general-purpose server or to isolate or demarcate some or all gaming machine administration and operations data and functions from the general-purpose server and thereby increase security and limit the possible modes of access to such operations and information.

Alternatively, exemplary gaming system 50 can be isolated from any other network at the establishment, such that a general-purpose server 60 is essentially impractical and unnecessary. Under either embodiment of an isolated or shared network, one or more of the special-purpose servers are preferably connected to sub-network 80, which might be, for example, a cashier station or terminal. Peripheral devices in this sub-network may include, for example, one or more video displays 81, one or more user terminals 82, one or more printers 83, and one or more other input devices 84, such as a ticket validator or other security identifier, among others. Similarly, under either embodiment of an isolated or shared network, at least the specialized server 61 or another similar component within a general-purpose server 60 also preferably includes a connection to a database or other suitable storage medium 70. Database 70 is preferably adapted to store many or all files containing pertinent data or information for a particular purpose, such as, for example, data regarding visual image data, video clips, other displayable items, and/or related data, among other potential items. Files, data and other information on database 70 can be stored for backup purposes, and are preferably accessible at one or more system locations, such as at a general-purpose server 60, a special purpose server 61 and/or a cashier station or other sub-network location 80, as desired.

In some embodiments, one or both of general-purpose server 60 and special purpose server 61 can be adapted to download various games to one or more gaming machines 10. Such downloaded games can include reel-based slots type games, with various virtual reels, reel symbols and reel stop locations for such symbols being downloaded to the gaming machine or machines 10. Such downloads can occur based on a request or command from a player or a casino operator, or can take place in an automated fashion by system 50, such as via a particular prompt or trigger. In the event that virtual reels are downloaded, such items may include one or more files or file portions relating to reel appearance, reel timing and/or reel sounds, as might pertain to the emulation of a given reel-type game as disclosed herein.

While gaming system 50 can be a system that is specially designed and created new for use in a casino or gaming establishment, it is also possible that many items in this system can be taken or adopted from an existing gaming system. For example, gaming system 50 could represent an existing cashless gaming system to which one or more of the inventive components or controller arrangements are added, such as controllers, storage media, and/or other components that may be associated with a dynamic display system adapted for use across multiple gaming machines and devices. In addition to new hardware, new functionality via new software, modules, updates or otherwise can be provided to an existing database 70, specialized server 61 and/or general-purpose server 60, as desired. Other modifications to an existing system may also be necessary, as might be readily appreciated.

Rotating Reels for Reel Based Gaming Machines

Figure 3A:
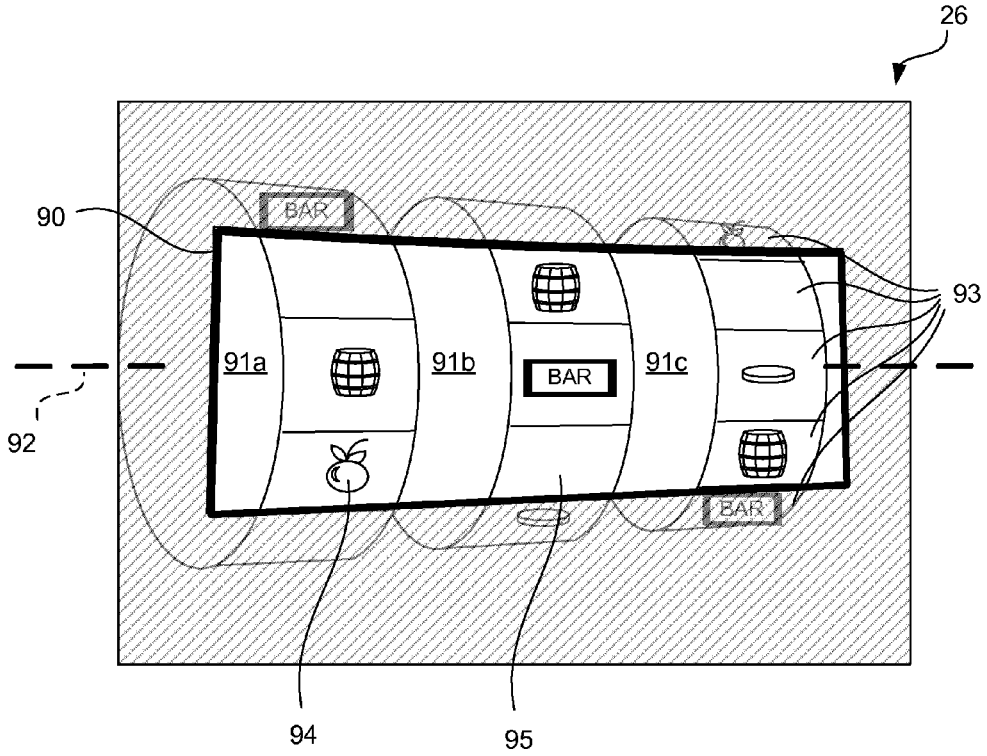
FIG. 3A illustrates in partial perspective view three exemplary adjacent rotating reels adapted for use in a gaming machine.
Figure 3B:
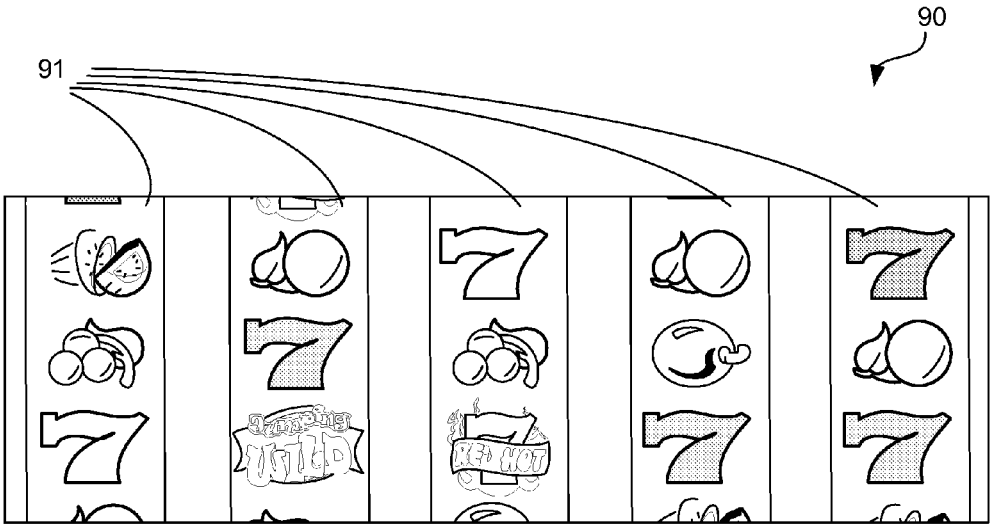
FIG. 3B illustrates a screenshot in front elevation view of five exemplary adjacent virtual rotating reels adapted for use in a processor-based gaming machine.

Turning now to FIGS. 3A and 3B, two different examples of adjacent rotating reels adapted for use in a gaming machine are presented. As will be readily appreciated, such adjacent rotating reels can be actual physical mechanical reels, such as the three adjacent reels presented in FIG. 3A, or they can be virtual reels that have been adapted to emulate physical reel on the display of a processor based gaming machine, such as the five adjacent reels shown in the screenshot of FIG. 3B. It will be readily appreciated that many of the items and features involved in the presentation of such gaming reels are common to both physical mechanical reels and virtual simulated reels, such that the various exemplary items and features of both types of reels described herein can apply similarly to the other type of reel. For example, while the three reels of FIG. 3A are described here as physical mechanical reels, they might also be virtual (i.e., simulated mechanical) reels that could be shown on a video display 26 of processor-based gaming machine 10.

As shown in FIG. 3A, gaming reels 91*a*, 91*b* and 91*c* are adapted to rotate about a common axis 92, such as during game play. Each wheel has a plurality of reel stops 93, each of which contains one static reel symbol 94 or, in some embodiments, only empty space comprising a "ghost" or "blank" 95. Each static reel symbol 94 or blank 95 is generally contained within its own reel stop 93. Static reel symbols 94 can include bars, fruits, coins, or barrels, as shown, and/or may also include a vast variety of other symbols suitable for use in a reel game, as will be readily appreciated. A viewing window 90 is adapted such that reels 91*a*, 91*b* and 91*c* can be seen therethrough, and it will be understood that such a viewing window can be used on wager-based gaming machines that include virtual reels on a video display. As can be seen, viewing window 90 is adapted such that only some of the reel stops 93 may be seen, while others are hidden from view. For example, reel 91*c* has reel stops 93 containing a blank, a coin and a barrel that can be seen, and also reel stops containing a cherry and a bar that cannot be seen at the same time through viewing window 90. As shown, reels 91*a*, 91*b* and 91*c* are stopped such that a barrel, a bar and a coin are the visible reel symbols on the reel stops that have stopped across a center payline visible at the center of viewing window 90.

FIG. 3B depicts five adjacent virtual reels 91, which reels can be substantially similar to the three reels of FIG. 3A. For example, each of the five virtual reels is visible through a viewing window 90, and various visible reel symbols from the reel stops of virtual reels 91 can be seen through the viewing window, while others cannot be seen therethrough at the same time. Reel symbols include cherries, watermelons, plums, oranges, other fruits and various numeral "7"s of different colors and designations, as well as "wild" symbols. Of course, many other specific reel symbols may also be used in addition to or instead of the examples that are illustrated. Unlike the three-reel example of FIG. 3A, the five-reel example of FIG. 3B does not include any reel stops that comprise ghosts or blank regions. It will be readily appreciated that the various embodiments of the present invention may be practiced with or without gaming reels that have blank reel stops thereupon. In general, many gaming reels, such as those shown in FIGS. 3A and 3B are configured such that three reel stops are in full view through the applicable viewing window. It will be understood, however, that other embodiments might be used that result in more or fewer reel stops per reel being visible at any given time, such as via different sizes in reel stops and/or the viewing window.

Multimedia Emulation of Physical Rotating Reels

Various embodiments of the present invention relate to the more realistic presentation of simulated rotating reels on a processor-based gaming machine, such as on one or more video displays and one or more accompanying speakers. This can be accomplished at least in part through the use of a specialized multi-layer display adapted for a more realistic visual emulation of rotating reels, as well as a specialized reel spin timer, a specialized reel sound generator, and/or one or more speakers adapted to present physical reel sounds, which sounds may be presented in stereo for a more realistic audio emulation of rotating reels.

Figure 4:
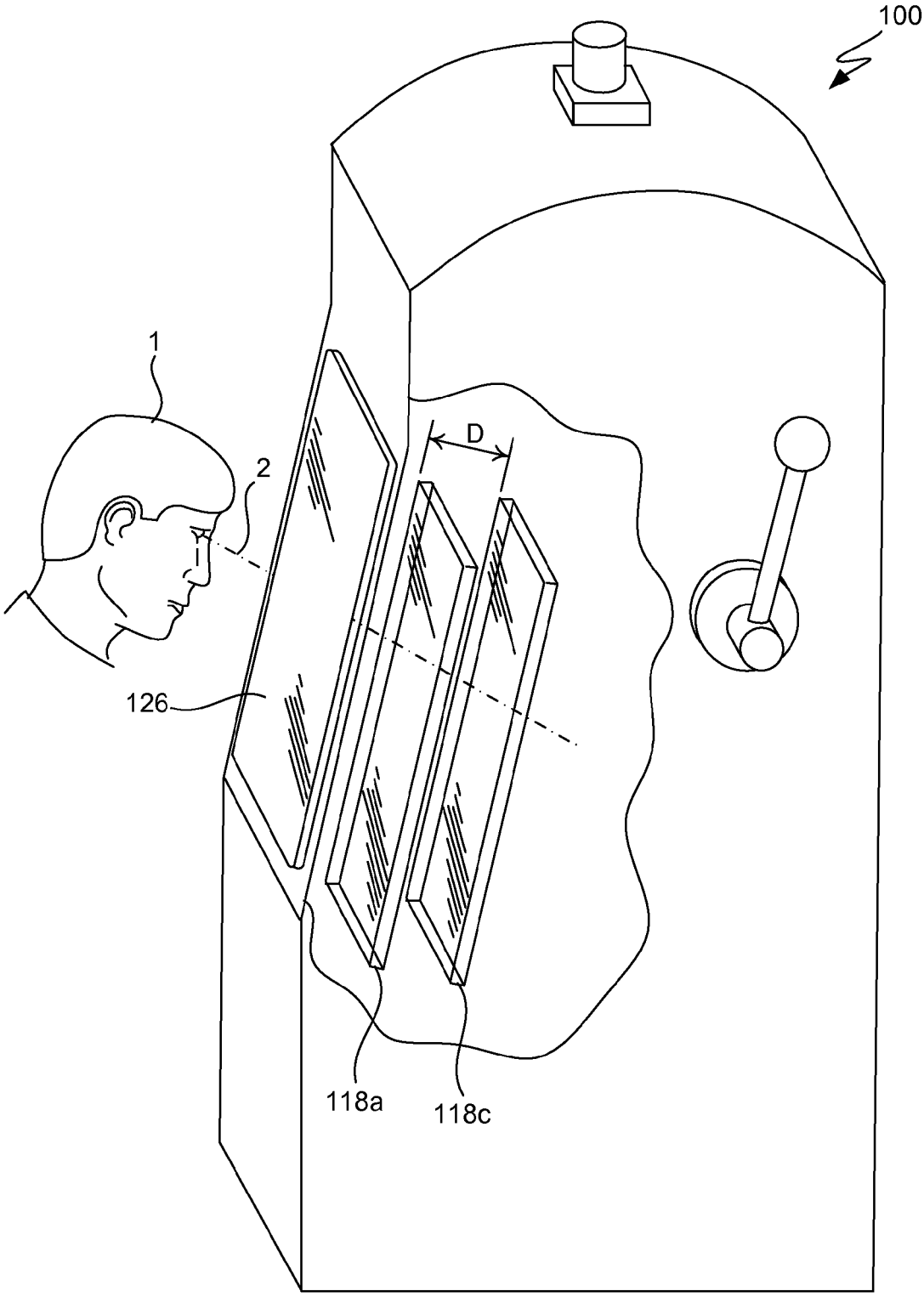
FIG. 4 illustrates in partial perspective and cut-away view an exemplary processor-based gaming machine having a multi-layer display according to one embodiment of the present invention.

Turning now to FIG. 4, an exemplary processor-based gaming machine having a multi-layer display according to one embodiment of the present invention is illustrated in partial perspective and cut-away view. Although the various gaming machines, devices, systems and methods involving more realistic emulations of physical reels set forth herein can be used on many types of processor-based gaming machines or systems, it is specifically contemplated that such devices and techniques can be applied to a gaming machine, terminal or system having a multi-layer display, such as multi-layer display gaming machine 100. It will be readily appreciated that multi-layer display gaming machine 100 can be substantially similar to processor-based gaming machine 10 described above, with the notable exception that a multi-layer display is installed within gaming machine 100.

Such multi-layer displays in a gaming machine can include, for example, those that are from or similar to commercially available products from PureDepth, Inc. of Redwood City, Calif. The PureDepth technology incorporates two or more LCD displays into a physical unit, where each LCD display is separately addressable to provide separate or coordinated images between the LCDs. Many PureDepth display systems include a high-brightened backlight, a rear image panel, such an active matrix color LCD, a diffuser, a refractor, and a front image plane; these devices are laminated to form a stack. The LCDs in these units are stacked at set distances, such as distance "D." As well as the binocular depth cue, PureDepth units feature intrinsic motion parallax, where the x and y distance changes between objects displayed on different video planes depending on viewing angle. In addition, separate focal planes may literally be brought in and out of focus depending on the focal length of the lens in the viewer's eye.

The layered display devices 118*a*, 118*c*, which may be layered LCD devices, for example, may be used in a variety of manners to output games on a gaming machine. In some cases, video data and images displayed on the display devices 118*a* and 118*c* are positioned such that the images do not overlap (that is, the images are not superimposed). In other instances, the images overlap. It should also be appreciated that the images displayed on the display screen can fade-in fade out, pulsate, move between screens, and perform other inter-screen graphics to create additional affects, if desired. Further, although described with respect to LCD screens or devices, it will be readily appreciated that other display technologies may also be adapted for use with respect to such multi-layer displays.

In a specific embodiment, display devices or screens 118*a* and 118*c* display co-acting or overlapping images to a person or viewer 1 looking at the display devices at a front display panel 126 and along a line-of-sight 2. For example, front display screen 118*a* may display paylines in transparent portions that illuminate winning combinations of reels disposed on back display screen 118*c*. With respect to further examples, it is again noted that external loading and changing of simulated reel games can be had with gaming machine 100, such as described above with respect to wager-based gaming system 50. This can permit a casino or gaming establishment to change video on each of the layered display devices, and their transparency, without physically altering the gaming machine or requiring maintenance. Thus, the number of virtual slot reels may be changed from 3 to 5 to 9, or some other number. In this case, each display device or screen 118*a*, 118*c* can change the position of its viewing window for viewing of the different number of virtual slot reels. Symbols on each virtual slot reel may also be changed. Also, a pay table shown on front display device 118*a* may be changed at will, in addition to changing whether a bonus or progressive game is shown on the back display device 118*c*, for example. This permits the same multi-layer display gaming machine 100 to play new games simply by downloading data onto the machine.

As will be readily appreciated, the layered display devices 118*a*, 118*c* may be used in a wide variety of manners to output games on a gaming machine. In some cases, video data and images displayed on the display devices 118*a* and 118*c* are positioned such that the images do not overlap, while in other instances, the images do overlap. It should also be appreciated that the images displayed on the display screen can fade-in fade out, pulsate, move between screens, and perform other inter-screen graphics to create additional affects, if desired. The multiple display devices may each display their own graphics and images, or cooperate to provide coordinated visual output. Objects and graphics in a game may then appear on any one or multiple of the display devices, where reels and other graphics on the front screen 118*a* blocks the view objects on the back screen 118*c*, depending on the position of the viewer relative to the screens. This provides actual perspective between the graphics objects, which represents a real-life component of 3D visualization.

In some embodiments, the multiple display devices output video for different games or purposes. For example, one display device may output a reel game, while another display device outputs a bonus game or pay table associated with the other display, while still another display device provides a progressive game or is reserved for player interaction and video output with a touchscreen. Other combinations may be used, as may be desired. Furthermore, while the foregoing embodiment has been described with respect to only two screens, it will be readily appreciated that additional screens may also be used for such a multi-layer display. For example, a middle screen (not shown) can be disposed between front layered screen 118*a* and back layered screen 118*c*, with such a middle screen also being adapted for the presentation of a coordinated visual image to a viewer. Still further screens may also be implemented into the multi-layer stack, as desired.

Wager based games output by the display devices or screens in such a multi-layer display may include, for example, any video game emulation that portrays one or more reels. Typically, the gaming machine simulates 'spinning' of the video reels using motion graphics for the symbols on the reel strips and motion graphics for the mechanical components. In various particular embodiments, the use of multiple screens may be made to account for any special effects or more realistic simulations that are desired through the use of a multi-layer display. For example, reel symbols may be moved from a back display to a front display and then to the back display again as they appear to rotate or spin along their respective virtual reels. Such movement of reel symbols from one screen to another within a multi-layer display can aid in a more realistic emulation of physical mechanical reels on a processor-based gaming machine. Other details regarding the depiction of simulated reels on a multi-layer display can be found in U.S. patent application Ser. No. 11/858,695, filed on Sep. 20, 2007, and entitled "Realistic Video Reels," which application is incorporated herein by reference in its entirety and for all purposes.

Various embodiments of the present invention can involve a more realistic emulation of physical reels though additional visual techniques, which can be used on processor-based gaming machines having multi-layer displays as well as those having more traditional displays, such as a simple CRT, LCD, flat panel display, or the like. Such visual techniques can include varying the timings of reel spin lengths as well as successive reel stops, which timing variances may involve sampling the spins of actual physical reels and modeling virtual reel spin times and successive reel stop times after the sampled physical reel spins. Various levels of randomization may also be introduced into such reel spin and reel stop times, so as to more realistically simulate the slightly varying reel spin and reel stop times of actual physical reels.

Various embodiments of the present invention can also involve a more realistic emulation of physical reels though added audio techniques, which audio techniques can be used separately or in combination with one or more of the above visual techniques. Such added audio techniques can include providing audio playback of actual sounds sampled and recorded from rotating physical reels, which replayed sounds can be selected from multiple and/or lengthier sound samplings from mechanical reels that are stored in an associated memory. A separate audio track can be implemented for each virtual reel, and such separate tracks can be directed for play at a plurality of speakers, which play can be stereophonic in nature. Variances in the audio playback can also be similarly randomized, so as to more realistically simulate the slightly varying sounds of actual physical reels in motion.

Figure 5:
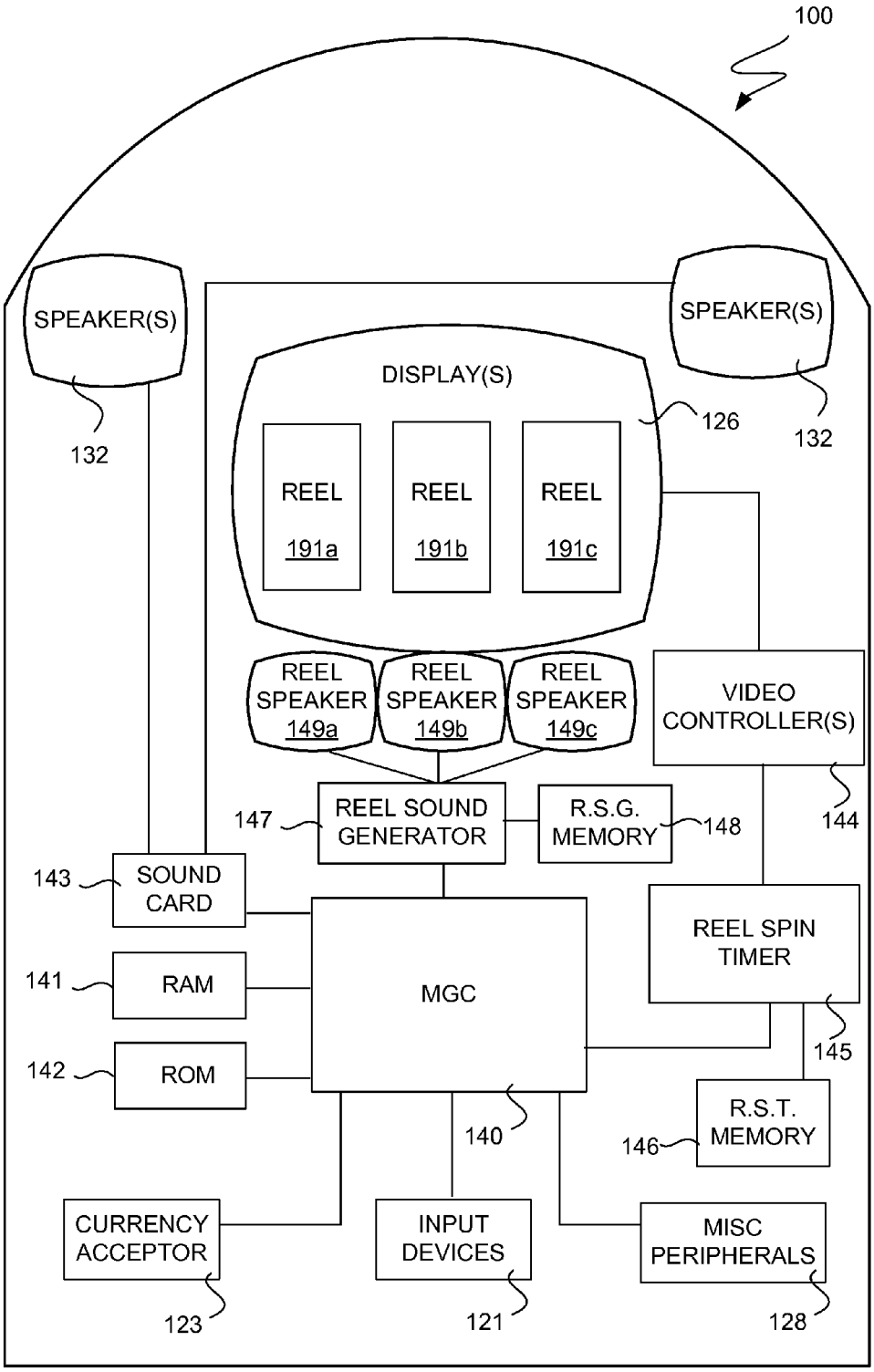
FIG. 5 illustrates in block diagram format various components of an exemplary processor-based gaming machine adapted to provide realistic emulations of physical reels both visually and audibly according to one embodiment of the present invention.

Referring next to FIG. 5, various components of an exemplary processor-based gaming machine adapted to provide more realistic emulations of physical reels both visually and audibly according to one embodiment of the present invention are illustrated in block diagram format. Processor-based gaming machine 100 contains many components that can be similar or identical to those set forth in gaming machine 10 above. For example, general speakers 132, input devices 121 and currency acceptor 123, as well as other peripheral devices 128, can correspond to similar items in gaming machine 10. As noted above, display(s) 126 can include a multi-layer display such as that shown and described with respect to FIG. 4. In some alternative embodiments, however, it will be appreciated that various visual and audio emulation techniques disclosed herein can be presented with respect to a gaming machine having a more traditional display, rather than a multi-layer display.

One or more sound cards 143 can be used to drive general speakers 132, and one or more video cards or controllers 144 can be used to drive display(s) 126, which display(s) can be adapted to present virtual gaming reels 191*a*, 191*b*, 191*c*. In various embodiments involving multi-layer displays, multiple video cards or controllers 144 can be used, such as one video card or controller for each separate screen, as will be readily appreciated. Alternatively, one video card or controller can be used to drive multiple screens within a multi-layer display. In addition, although three virtual reels—and accompanying reel speakers—are shown for purposes of illustration, it will be readily appreciated that any number of virtual reels and/or reel speakers can be used. For example, gaming machine 100 can be adapted to present games involving 3, 5, 7, 9 or any other number of virtual reels. In the event that other number of virtual reels are presented, suitable adjustments to one or more of the various specialized emulation components can be provided, as may be appropriate.

As noted above, a master gaming controller 140 adapted to execute or control one or more aspects of wager based games is in communication with various other gaming machine components, either directly or via other components. For example, while master gaming controller 140 might be in direct communication with various input devices or other peripherals, one or more video cards or controllers 144 can be interspersed between the master gaming controller and display(s) 126, such that communication to the display(s) is indirect. Various memory or storage components, designated as RAM 141 and ROM 142 might be accessible to master gaming controller 140, and such storage components may be dedicated to the master gaming controller, or could be shared by other gaming machine components.

In addition to a multi-layer display, various other specialized components adapted to aid in the more realistic emulation of physical reels can be a part of processor-based gaming machine 100. Such components can include a specialized reel spin timer 145 and associated memory 146, a specialized reel sound generator 147 and associated memory 148, and a plurality of reel speakers 149*a*, 149*b*, 149*c* adapted to present simulated physical reel sounds.

In various embodiments, each of reel speakers 149*a*, 149*b*, 149*c* can be dedicated to its own respective virtual reel, so as to provide isolated sounds for each reel, thereby improving the audio emulation of physical reels. In some embodiments, this can involve a one-to-one correspondence between virtual reels and dedicated reel speakers. Alternatively, one or more reel speakers can carry sounds for more than one virtual reel. For example, where only three reel speakers are used, each reel speaker can be dedicated to its own separate corresponding virtual reel for three reel games, but may need to carry sounds for more than one virtual reel for reel games involving 4 or more virtual reels. Where dedicated reel speakers 149 are used, such dedicated reel speakers can be placed in locations that are relatively close to where their respective virtual reels are presented. For example, each of dedicated reel speakers 149*a*, 149*b*, 149*c* can be placed within the gaming machine cabinet or housing, beneath display 126 and spaced apart in close or rough correspondence with where their corresponding or respective virtual reels will appear on display 126. Other locations for dedicated reel speakers may also be used, such as on the underside of a player input panel, and/or behind a belly glass or top glass. In addition, a plurality of separate audio channels may be used, such as one separate audio channel per dedicated reel speaker 149. In this manner, sounds to the various dedicated reel speakers can be presented in stereo for added effect. In alternative embodiments, dedicated reel speakers are not used, and the various sound emulations disclosed herein can be presented at general speakers 132.

One or both of reel spin timer 145 and reel sound generator 147 can be dedicated processors located separately from master gaming controller 140, as shown in FIG. 5, so as to alleviate some of the burdens that are typically placed on the master gaming controller of a wager-based gaming machine. Such a separate processor or processors could be, for example, the Pentium III processor chip made by Intel Corporation of Santa Clara, Calif., although other suitable processors can also be used. Alternatively, one or both of the reel spin timer and reel sound generator can be contained within or even be a part of the master gaming controller itself (not shown). Reel spin timer 145 may be in communication with master gaming controller 140, one or more video controller(s) 144 and/or one or more display(s) 126, while reel sound generator 147 can be in communication with master gaming controller 140, one or more sound cards (not shown) and/or one or more dedicated reel speakers 149*a*, 149*b*, 149*c*. Reel sound generator 147 may also be in communication with sound card 143 and/or general speaker(s) 132, particularly where dedicated reel speakers are not used.

One or more reel spin timer storage units or memory devices 146 can be associated with reel spin timer 145, and such memory devices 146 can be dedicated to the reel spin timer or shared with other gaming machine components. Similarly, one or more reel sound generator storage units or memory devices 148 can be associated with reel sound generator 147, and such memory devices 148 can be dedicated to the reel sound generator or shared with other gaming machine components. Such reel spin timer memory device(s) 146 and reel sound generator memory device(s) 148 could be separate specific memory chips and/or also an internal hard disk drive, such as, for example, a 40 gigabyte model 6K040L0 hard drive made by Maxtor Corporation of Milpitas, Calif., although other suitable memory components can also be used. In some embodiments, both reel spin timer memory device(s) and reel sound generator memory device(s) can be contained on the same set of memory chips and/or hard drive (not shown).

Reel spin timer memory device(s) 146 can be used to store various files and data with respect to different timings involved in the presentation of virtual reels, such as, for example, the length of reel spins and time intervals between the stopping of reels. Such files and/or data can contain formulae and/or table data for simulated reel spin and reel stop time intervals, as well as data from sampled timing patterns of actual mechanical reels. Reel sound generator memory device(s) 148 can be used to store various files and data with respect to the various simulated sounds involved in the presentation of virtual reels, such as, for example, the sounds of spinning physical reels, reel latches, stepper motors, solenoid actuations and other mechanical sounds that may be associated with the operation of physical reels. Such files and/or data can contain sound samplings or recordings from actual physical reels, as well as formulae and/or table data to readily facilitate randomized selections of such sound samplings for a more realistic audio emulation of physical reels.

In general, when physical mechanical reels are used for a reel based game, each reel spin tends to vary in its exact length of time due to a number of factors, which factors can include various imperfections in reel equipment, as well as the actual location on the reel of a selected reel stop, at least for electromechanical stepper reels. Furthermore, the length of the time delay from stopping one physical mechanical reel to another can also vary, again due to various imperfections in reel equipment and the reel locations of selected reel stops, among other factors. In many processor-based simulations of mechanical reels on video displays, however, the length of time to show a spinning reel and the time interval from one reel stopping to the next is often the same from one reel to another and from one game to the next.

Through the use of the various components described above with respect to processor-based gaming machine 100, a more accurate emulation of physical reels can be had with respect to varying timings of reel starts, spins and stops. Reel spin timer 145 can be used to control or facilitate the control of the start, spin and stop times or durations for one or more virtual reels 191 presented on display 126 of gaming machine 100. In some embodiments, reel spin timer 145 can facilitate the control of spin times for all virtual reels presented for a given reel game. Such timings and durations for reel starts, spins and stops can be selected randomly from a set of acceptable timings and durations for each category, and each such timing and/or time duration or interval can be selected separately for each separate virtual reel in a given reel game presentation. As noted above, reel start, spin duration and stop times can be sampled from actual physical reels, with the specific results being stored in a table or other data format for random selection by reel spin timer 145.

In some embodiments, separate reel start, spin duration and/or stop times can be sampled and stored separately for each separate virtual reel. That is, the potential times that could selected for virtual reel 191*a* can come from a separate table or set of stored values than those for virtual reel 191*b*. Thus, various idiosyncrasies specific to a given physical reel can be somewhat preserved and transferred to a given virtual reel. In various embodiments, reel start, spin duration and/or stop times can vary from game to game. For example, stored reel times for virtual reels in a "Red White and Blue" reel type game can be completely different and stored in different files than those times for virtual reels in a "Double Diamond" reel type game.

As one non-limiting illustrative example, a first game might result in all reels starting at the same time, with virtual reel 191*a* spinning for 3.52 seconds, virtual reel 191*b* spinning for 4.07 seconds, and virtual reel 191*c* spinning for 4.49 seconds before each reel stops in succession. A second subsequent game on the same processor-based gaming machine with the same virtual reels might result in all reels similarly starting at the same time, with virtual reel 191*a* spinning for 3.45 seconds, virtual reel 191*b* spinning for 4.01 seconds, and virtual reel 191*c* spinning for 4.62 seconds before each reel stops in succession. Of course, numerous other time intervals, ranges and possibilities may also be used, as will be readily appreciated.

In various embodiments, a timing formula can be used to facilitate the time delay between stopping one virtual reel and the next virtual reel in a reel type game where reels are spun and then stopped in succession. Such a formula could be implemented by reel spin timer 145 or a similar processing component, and might be:

$$\text{FurtherSpinMS}=\text{ConstantMS}+\text{Rand}(0,21)*\text{StopMS} \quad (1)$$

Where: FurtherSpinMS represents the time delay or interval between stopping one reel and stopping the next reel; ConstantMS represents a minimum constant time; StopMS is the amount of time that it takes for a stepper motor to spin from one reel stop to the next, and Rand(0,21) represents a random integer from 0 to 21. In the event that a table is used, such a formula might simply be:

$$\text{FurtherSpinMS}=\text{TableMS}[\text{Rand}(0,21)] \quad (2)$$

Where TableMS represents a particular value taken from a table corresponding to the random integer that is generated. Of course, other numbers besides 21 may be used for limiting the generation of random numbers, and it will be appreciated that a wide variety of numbers, ranges and random number generation processes can be used.

Through the use of the various components described above with respect to processor-based gaming machine 100, a more accurate emulation of physical reels can be had with respect to the audio presentations that correspond to virtual reels 191 during game play. Reel sound generator 147 can be used to generate or facilitate the generation of simulated physical reel sounds corresponding to one or more virtual reels 191. As noted above, physical reel sounds can be sampled from actual physical reels, with the specific results being recorded and stored on various files, such as, for example, .wav files, that can be located on reel sound generator memory 148 or any other suitable associated memory. Reel sound generator can retrieve various reel sound files or portions of reel sound files from associated memory 148, and then distribute or facilitate the distribution of reel sounds to one or more speakers, such as dedicated reel speakers 149*a*, 149*b*, 149*c*. As noted above, the various dedicated reel speakers can correspond to different virtual reels, and sounds presented thereon can come from separate and discrete audio channels, such that stereo sound is provided.

In various embodiments, the stored recordings of actual physical reels can include multiple and/or lengthy sound recordings, such that snippets or portions of a given sound recording file can be selected randomly for any specific sound playback and emulation. For example, the general sounds of an actual physical reel spin, accompanying stepper motor whine and other associated mechanical sounds can be recorded for ten seconds, twenty seconds, or more, and such a recording can then be stored on one or more files and sampled from randomly whenever accompanying sound for a spinning virtual reel is to be provided, such as for the few seconds that such a virtual reel actually spins during game play. As one particular example, the reel spin sounds provided for reel 191*a* during the play of a first reel game can be taken from time 2.32 seconds through time 5.75 seconds on a twenty second sound recording file of reel spin for that reel. During a subsequent reel game, the reel spin sounds provided for reel 191*a* can be taken from time 12.66 seconds through time 15.97 seconds from that same twenty second sound recording file. While the differences in overall sounds may be slight from one sampled clip to the next, the overall effect is that the provided sounds are slightly different from one game play to the next, which adds to the overall realistic emulation of physical reels.

Similar to the foregoing embodiments for reel spin timings, such sound recordings can be made and stored in numerous sound files, which can be sampled from for each virtual reel separately. That is, the potential sounds that could selected for virtual reel 191*a* can come from a separate sound file or set of sound files than those for virtual reel 191*b*. In fact, each virtual reel for each different reel type game on gaming machine 100 can have its own sound file or set of sound files, such that each virtual reel may sound slightly different than every other virtual reel, as in the case of actual physical reels. As will be readily appreciated, the use of reel sound generator 147 can be combined with the use of reel spin timer 145 for greater reel emulation effects. For example, reel spin timer 145 can generate a reel spin start, spin time and stop for each virtual reel 191, which reel spin start, spin and stop times can then be provided to the reel sound generator 147 so that appropriate lengths of sound can be randomly sampled for each reel function of each separate virtual reel.

Various "biasing" effects can also be provided for the various virtual reels with respect to each other, both in terms of reel spin times and simulated sounds. Such reel biasing might involve assigning a "late" value to a given virtual reel, which late value might result in generally later start, spin and stop times, such as what might occur in a physical reel that is generally stickier or slower than the other reels in a given machine. Such biasing values might also be provided with respect to sounds, such as the addition of a systematic "hiss" or a clicking for a given virtual reel emulating a physical reel that is old or might need maintenance. As will be readily appreciated, such biasing effects might be subtle, and may be provided for only one virtual reel or a subset of virtual reels, such that the overall effect is a more realistic emulation of a set of individual physical reels operating to present a game.

In various embodiments, reel sound generator 147 can also be used to modify the sounds that are recorded in the various sound files, so as to provide even more realistic emulations of the sounds of physical reels. Such sound processing can include generally randomizing the various tones, length, pitch or content of sounds from one simulated reel spin to the next. For such purposes, reel sound generator 147 may include a digital sound processor adapted for the dynamic presentation and/or modification of sounds from recorded sound files. Further, in the event that separate and discrete channels are used for each separate reel speaker, or at least where multiple audio channels are used, separate controls to vary volume, bass, treble, pitch or content can be had with respect to each separate channel.

In some embodiments where one or more speakers are adapted to provide stereo sound, for example, with respect to accurate sound emulations of rotating reels, such stereo speakers may also be used for other dynamic presentations on the gaming machine. Since gaming machine 100 is a processor-based gaming machine, it will be readily appreciated that a wide variety of displays and special effects can be provided. Various displays can involve animated reel symbols, figures or other objects, which items may move across the display 126. In embodiments that include a multi-layer display, such animated reel symbols or other objects can also be adapted to move back and forth depthwise between the various screens of the multi-layer display. In the event that stereophonic sounds are provided on multiple speakers, such speakers can be used to provide sounds that are in sync with the motions of such animated reel symbols or other objects. For example, an animation that involves a reel symbol or object moving from left to right across screen 126 might be accompanied by sounds that move from reel speaker 149*a* to reel speaker 149*b* to reel speaker 149*c* as the object moves across the screen. Again, while dedicated reel speakers 149*a*, 149*b*, 149*c* may be used to present stereo sounds and/or sounds with respect to the various virtual reels 191, other general speakers 132 may also be used for such purposes.

In various embodiments, one or more gaming machine speakers, such as general speakers 132 and/or dedicated reel speakers 191, may be used to provide haptic or quasi-haptic feedback to a person near the gaming machine. In addition to the illustrated speakers, gaming machine 100 can include a separate subwoofer or other low-frequency sound emitter (not shown) that provides deeper gaming machine shaking noises and/or other loud effects associated with mechanical events. Such a speaker or speakers can be used create shaking sounds and vibrations in a processor-based gaming machine that emulated the kind of shaking sounds and vibrations that are experienced in a physical reel-based gaming machine. For a video reel game, this helps to enhance the feeling of reels moving and stopping. All three reels stopping at the same time can produce a thump from the main cabinet, as might be witnessed in a mechanical device. Wins or special gaming outcomes may also shake the cabinet via the use of such haptic speaker(s). In other embodiments, each dedicated reel speaker 149*a-c* can provide an emphatic loud thump as its corresponding virtual reel or reels stop, which thumps can result in perceptible vibrations, such as those that are experienced in physical rotating and stopping reels.

In various embodiments, processor-based gaming machine 100 can include solenoids or other mechanical system elements (not shown) that generate haptic noises and/or vibrations upon command by a processor. For example, a solenoid may be used to produce clicking sounds, which are often found in a traditional mechanical reel game as the reel spins and clicks against a mechanical surface. Other suitable mechanical systems to generate reel type noises can include actual physical latches, relays and motors, for example. In some embodiments, gaming machine 100 can also include a board of various mechanical sound devices (not shown) that are selectively engaged by a processor to provide haptic feedback during certain video game events, such as emulations of a reel based game.

It will be readily appreciated that the various disclosures herein with respect to processor-based gaming machines, virtual reels and methods involving the more realistic emulation of physical reels can also be applied to wager-based gaming systems having networked gaming machines and other network components. Such systems can include components and configurations such as those described above with respect to FIG. 2. In particular, such a wager-based gaming system can include a remote host that is in communication with some or all of the processor-based gaming machines, with the remote host being adapted to download reel spin times, values and/or tables, reel sound files, biasing values, other virtual reel parameters or any combination thereof to the networked gaming machines. Where gaming machines are to be networked in such a wager-based gaming system, various gaming machine embodiments can also include a network interface (not shown) coupling the gaming machine to the system and its various remotely located networked components. Such a network interface would preferably facilitate the downloading of the various items listed above to the networked gaming machines. Such items can be stored, for example, at database 70, and then be made available to various gaming machines within the gaming system.

Various reel spin timings and/or reel sound generations can be done by a network component, such as at the remote host, or within an individual gaming machine. Accordingly, a reel spin timer and/or reel sound generator may be located at the remote host, or elsewhere within the gaming system and outside of an individual gaming machine. Such a remotely located reel spin timer and/or reel sound generator could be beneficial to an overall system, particularly where such a system might have gaming machines that are not equipped with specialized reel spin timers and/or reel sound generators themselves. For example, where it is desirable for a system gaming machine to provide a realistic reel-type game having virtual reels, then the system can provide the various functions of a reel spin timers and/or reel sound generator where the system gaming machine does not have one or both of these components and is not otherwise equipped to provide such functions itself.

In some embodiments, reel spin timers and/or reel sound generators can be located both within individual gaming machines, as detailed above, and also on one or more system components, such as at a remote host. Whether a reel spin timer and/or reel sound generator is located on a system component or within a gaming machine, it is preferable that such a reel spin timer and/or reel sound generator be able to facilitate the provision of realistic reels on an associated display, particularly through the use of one or more timing and/or recorded sound files, which files can be stored on an associated internal gaming machine memory 146, 148 and/or at a network location, such as system database 70.

Method of Use

It will be readily appreciated that the method and illustrative flowchart provided herein are merely exemplary, and that the present invention may be practiced in a wide variety of suitable ways. While the provided flowchart may be comprehensive in some respects, it will be readily understood that not every step provided is necessary, that other steps can be included, and that the order of steps might be rearranged as desired by a given manufacturer, as desired.

Figure 6:
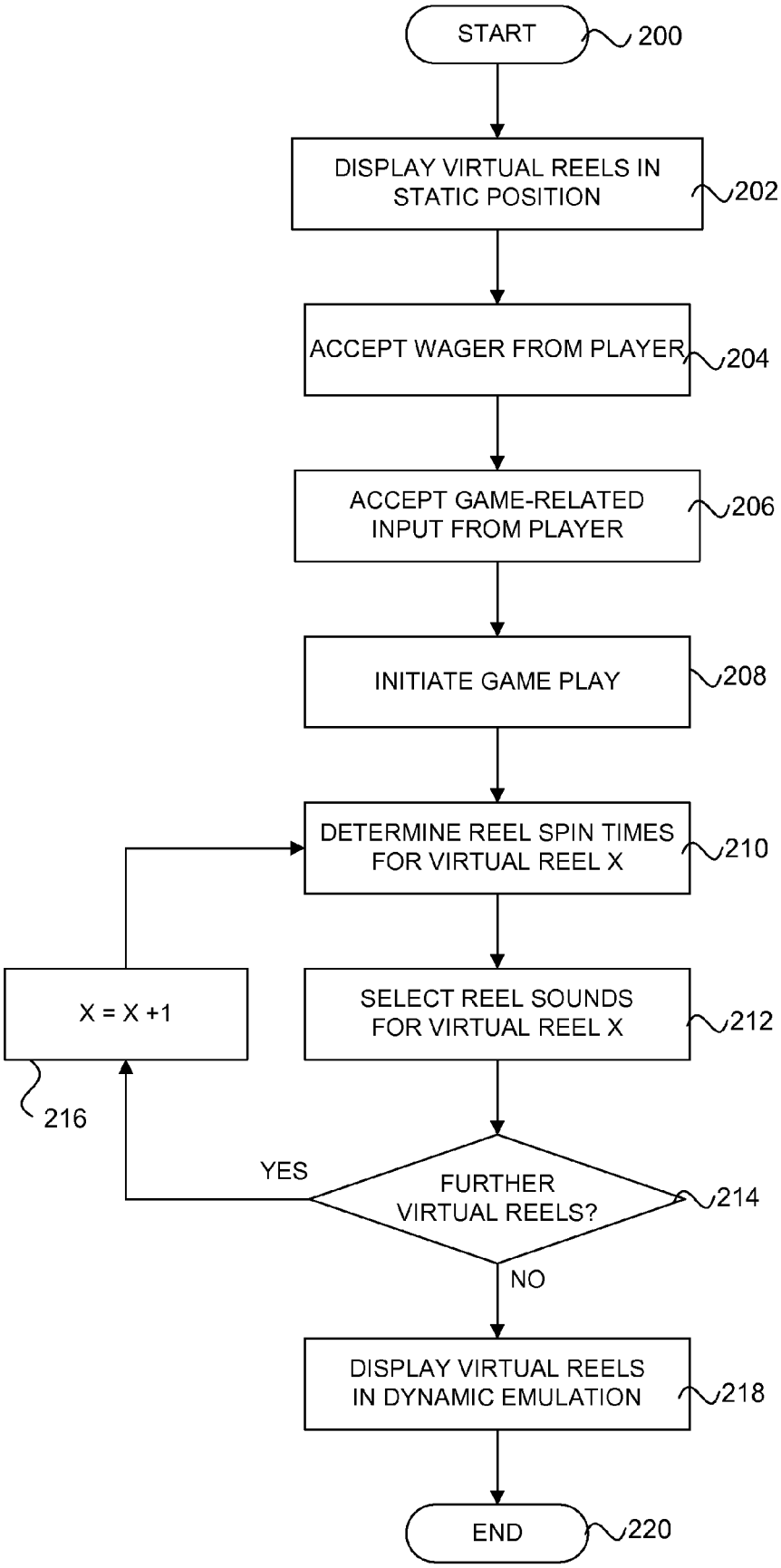
FIG. 6 illustrates a flowchart illustrating an exemplary method of presenting simulated reels on a processor-based gaming machine according to one embodiment of the present invention.

Specifically, FIG. 6 illustrates a flowchart illustrating one exemplary method of presenting simulated reels on a processor-based gaming machine according to one embodiment of the present invention. Such a method serves to illustrate an automated process whereby a specialized reel spin timer and/or reel sound generator can be used to provide more realistic reels. After start step 200, a first process step 202 involves displaying the various virtual gaming reels in a static position on a display of the gaming machine. Such a gaming reel or reels can be any of the exemplary gaming reels as described above. Process step 204 then involves accepting a wager from the player, process step 206 involves accepting a game related input from the player, and a game play is then initiated at process step 208.

After game play is initiated at step 208, the various reel start, spin duration and stop times are determined for a first virtual reel at process step 210. Such reel spin times can be determined by an associated reel spin timer, as detailed above, and can involve the random generation of an appropriate start time, spin duration and start time within a permissible range. Various biasing factors may also be applied to a given virtual reel, as may be desired. Upon the first occurrence of process step 210, the "X" value for "Virtual Reel X" can be 1, as will be readily appreciated.

Various reel sounds for the first virtual reel can be selected or generated at process step 212. Such reel sounds can be selected or generated by an associated reel sound generator, as detailed above, and can involve the random selection of sound clips or snippets from larger sound files. Various biasing factors may also be applied to a given virtual reel, as may be desired. Although shown in series, it will be readily appreciated that the processes in steps 210 and 212 can be provided in parallel, or in reverse order, as may be desired. After process step 212, an inquiry is then made at decision step 214 as to whether there are further virtual reels for which reel spin times and reel sounds need to be determined, selected and/or generated. If so, then X is incremented at process step 216, and the method reverts to steps 210 and 212 to determine such reel spin times and select or generate reel sounds for the next virtual reel. This process is repeated for each virtual reel, after which the method then moves to process step 218, where an emulation of the virtual reels in dynamic motion is displayed. After process step 218, the method then finishes at end step 320. Of course, additional steps may also apply to such a process, as may be desired.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A processor-based gaming machine configured to accept a wager, play a wager-based reel-type game of chance based on the wager and grant a payout based on the result of the wager-based reel-type game of chance, comprising:

an exterior housing arranged to contain a plurality of internal gaming machine components therein;

a master gaming controller in communication with at least one of said plurality of internal gaming machine components and configured to execute one or more aspects of said wager-based reel-type game of chance, the master gaming controller configured to generate video data for displaying a plurality of rotating video reels on an electronic video display device;

said electronic video display device configured to receive the video data from the master gaming controller and to present the plurality of rotating video reels using the received video data, said plurality of rotating video reels including a plurality of video reel symbols distributed on a plurality of video reel stops thereupon;

one or more speakers in communication with said master gaming controller and configured to present sounds with respect to said plurality of rotating video reels;

a reel spin timer in communication with at least one of said master gaming controller and said electronic video display device, wherein said reel spin timer is configured to randomly determine and select spin times from a plurality of acceptable spin times to vary the spin times of said plurality of rotating video reels from one game play to another of reel-type games and to vary the stop times of said plurality of rotating video reels from one game play to another of reel-type games on said processor-based gaming machine to emulate imperfections of a rotating mechanical reel; and a reel sound generator in communication with at least one of said master gaming controller and said one or more speakers, wherein said reel sound generator is configured to provide sounds to said one or more speakers with respect to said plurality of rotating video reels, said provided sounds varying from one game play to another of reel-type games on said processor-based gaming machine and said provided sounds emulating sounds of a rotating mechanical reel.

2. The processor-based gaming machine of claim 1, wherein said one or more speakers comprises a plurality of dedicated reel speakers located in close proximity to the display of said plurality of rotating video reels.

3. The processor-based gaming machine of claim 2, wherein each of said plurality of dedicated reel speakers corresponds to one rotating video reel.

4. The processor-based gaming machine of claim 2, wherein said plurality of dedicated reel speakers are collectively configured to present stereophonic sounds with respect to said plurality of rotating video reels.

5. The processor-based gaming machine of claim 2, wherein each of said plurality of dedicated reel speakers and each of said plurality of rotating video reels correspond to each other on a one-to-one basis.

6. The processor-based gaming machine of claim 1, wherein said plurality of acceptable spin times are based upon sampling actual physical reels from a mechanical or electromechanical reel-type gaming machine.

7. The processor-based gaming machine of claim 1, wherein said reel sound generator is configured to vary said provided sounds from one game play to another based upon random selections from one or more stored sound files.

8. The processor-based gaming machine of claim 7, wherein said one or more stored sound files are based upon sampling actual physical reels from a mechanical or electromechanical reel-type gaming machine.

9. The processor-based gaming machine of claim 1, further including:

a storage device in communication with said reel spin timer, said storage device configured to store a plurality of files with respect to said plurality of acceptable spin times.

10. The processor-based gaming machine of claim 1, further including:

a storage device in communication with said reel sound generator, said storage device configured to store a plurality of files with respect to reel sounds.

11. The processor-based gaming machine of claim 1, further including:

a network interface configured to couple said gaming machine to one or more remotely located networked components, said network interface configured to facilitate the downloading of reel spin times, reel sounds, or both to said gaming machine.

12. A method of presenting simulated reels on a processor-based gaming machine, comprising:

generating video data for displaying a plurality of simulated video reels on an electronic video display device of said processor-based gaming machine;

displaying on the electronic video display of said processor-based gaming machine said plurality of simulated video reels in a static, non-rotating position, based on said video data;

accepting a monetary value wager from said player;

accepting a game-related input from said player;

initiating the play of a wager-based reel-type game of chance as a result of said game-related input;

randomly determining and selecting, by a reel spin timer, reel spin times from a plurality of acceptable reel spin times and determining stop times for each of said plurality of simulated video reels, said reel spin times and said stop times varying from one game play to another of reel-type games on said processor-based gaming machine to emulate imperfections of a rotating mechanical reel; and displaying on said electronic video display said plurality of simulated video reels in rotational motion, wherein said presentation is based at least in part on the generated video data and on the determined and selected reel spin times and said stop times for each of said plurality of simulated video reels so as to emulate the motion of a rotating mechanical reel.

13. The method of claim 12, further comprising the steps of:

generating reel sounds for each of said plurality of simulated reels, said reel sounds varying from one game play to another of reel-type games on said processor-based gaming machine and said reel sounds emulating sounds of a rotating mechanical reel; and presenting said generated reel sounds on one or more speakers of said processor-based gaming machine.

14. A wager-based gaming system, comprising:

a plurality of processor-based gaming machines configured to accept a wager, play a wager-based reel-type game of chance based on the wager and grant a payout based on the result of the game, said plurality of processor-based gaming machines including:

an exterior housing arranged to contain a plurality of internal gaming machine components therein, a master gaming controller in communication with at least one of said plurality of internal gaming machine components and configured to execute one or more aspects of said wager-based reel-type game, the master gaming controller further configured to generate video data for displaying a plurality of rotating video reels on an electronic video display device, and said electronic video display device in communication with said master gaming controller and configured to present said plurality of rotating video reels based on the video data;

a remote host in communication with said plurality of processor-based gaming machines, said remote host being configured to download reel spin times, stop times and reel sounds to one or more of said plurality of processor-based gaming machines; and at least one reel spin timer in communication with at least one of said remote host and said plurality of processor-based gaming machines, wherein said at least one reel spin timer is configured to randomly determine and select spin times from a plurality of acceptable spin times to vary the spin times of said plurality of rotating video reels from one game play to another of reel-type games on one or more of said processor-based gaming machines and to vary the stop times of each of said plurality of rotating video reels from one game play to another of reel-type games on said processor-based gaming machine to emulate imperfections of a rotating mechanical reel.

15. The wager-based gaming system of claim 14, wherein said at least one reel spin timer is located at said remote host.

16. The wager-based gaming system of claim 14, further including:

at least one reel sound generator in communication with at least one of said remote host and said plurality of processor-based gaming machines, wherein said at least one reel sound generator is configured to provide sounds to one or more speakers with respect to said plurality of rotating video reels, said provided sounds varying from one game play to another of reel-type games on one or more of said processor-based gaming machines and said provided sounds emulating sounds of a rotating mechanical reel.

17. The wager-based gaming system of claim 16, wherein said at least one reel sound generator is located at said remote host.

18. A wager-based gaming machine, comprising:

an exterior housing arranged to contain a plurality of internal gaming machine components therein;

a master gaming controller in communication with at least one of said plurality of internal gaming machine components and configured to execute one or more aspects of a wager-based reel-type game of chance, the master gaming controller further configured to generate video data for displaying a plurality of rotating video reels on an electronic video display device;

said electronic video display device configured to display said plurality of rotating video reels based on the video data; and a reel spin timer in communication with at least one of said master gaming controller and said electronic video display device, said reel spin timer being configured to randomly determine and select spin times from a plurality of acceptable spin times to vary the spin times of said plurality of rotating video reels from one game play to another of reel-type games on said wager-based gaming machine and to vary the stop times of said plurality of rotating video reels from one game play to another of reel-type games on said wager-based gaming machine to emulate the imperfections of a rotating mechanical reel.

19. The wager-based gaming machine of claim 18, wherein said electronic video display device comprises a multi-layer display having a plurality of display screens positioned front to back with respect to each other.

20. A wager-based gaming machine, comprising:

an exterior housing arranged to contain a plurality of internal gaming machine components therein;

a master gaming controller in communication with at least one of said plurality of internal gaming machine components and configured to execute one or more aspects of a wager-based reel-type game of chance, the master gaming controller further configured to generate video data for displaying a plurality of rotating video reels on an electronic video display device;

said electronic video display device configured to present said plurality of rotating video reels based on the video data;

one or more speakers in communication with said master gaming controller and configured to present sounds with respect to said plurality of rotating video reels;

a reel spin timer in communication with at least one of said master gaming controller and said electronic video display device, said reel spin timer being configured to randomly determine and select spin times from a plurality of acceptable spin times to vary the spin times of said plurality of rotating video reels from one game play to another of reel-type games and to vary the stop times of each of said plurality of rotating video reels from one game play to another of reel-type games to emulate the imperfections of a rotating mechanical reel; and a reel sound generator in communication with at least one of said master gaming controller, said one or more speakers and the reel spin timer, said reel sound generator being configured to provide sounds to said one or more speakers with respect to said plurality of rotating video reels, said provided sounds varying from one game play to another of reel-type games on said wager-based gaming machine based at least in part on the spin times and the stop times of said plurality of rotating video reels and said provided sounds emulating sounds of a rotating mechanical reel.

21. The wager-based gaming machine of claim 20, wherein said one or more speakers comprises a plurality of dedicated reel speakers located in close proximity to the display of said plurality of simulated rotating reels.

22. The wager-based gaming machine of claim 20, wherein at least one of said one or more speakers is configured to provide haptic feedback with respect to the presentation of said plurality of simulated rotating reels.

23. The wager-based gaming machine of claim 22, wherein at least one of said speakers is configured to provide haptic feedback comprises a subwoofer.

* * * * *